US006900796B2

(12) United States Patent
Yasunishi et al.

(10) Patent No.: US 6,900,796 B2
(45) Date of Patent: May 31, 2005

(54) LIQUID CRYSTAL DISPLAY DEVICE AND METHOD FOR DRIVING THE SAME

(75) Inventors: Norio Yasunishi, Nara (JP); Futoshi Satoh, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 482 days.

(21) Appl. No.: 09/748,502

(22) Filed: Dec. 26, 2000

(65) Prior Publication Data

US 2001/0048407 A1 Dec. 6, 2001

(30) Foreign Application Priority Data

Dec. 27, 1999 (JP) ..... 11-371961

(51) Int. Cl.[7] ..... G09G 3/36; G09G 5/00

(52) U.S. Cl. ..... 345/204; 345/87; 345/99; 345/100

(58) Field of Search ..... 345/87–89, 90, 345/94–96, 99–101, 690–691, 204–214, 98, 60, 92; 349/143, 173

(56) References Cited

U.S. PATENT DOCUMENTS 5,644,329 A * 7/1997 Asari et al. ..... 345/89
5,798,740 A * 8/1998 Bitzakidis et al. ..... 345/92
5,841,411 A * 11/1998 Francis ..... 345/58
6,320,562 B1 * 11/2001 Ueno et al. ..... 345/87
6,496,170 B1 * 12/2002 Yoshida et al. ..... 345/87

FOREIGN PATENT DOCUMENTS

| | | |
|---|---|---|
| JP | 04-043320 | 2/1992 |
| JP | 06-019428 | 1/1994 |
| JP | 6-27899 | 2/1994 |
| JP | 11-52326 | 2/1999 |
| JP | 11-84342 | 3/1999 |
| JP | 11-133920 | 5/1999 |

* cited by examiner

*Primary Examiner*—Regina Liang
*Assistant Examiner*—Duc Q Dinh
(74) *Attorney, Agent, or Firm*—David G. Conlin; David A. Tucker; Edwards & Angell, LLP

(57) ABSTRACT

A method for driving a liquid crystal display device including a plurality of row electrodes intersecting a plurality of column electrodes, a scanning voltage applied to each of the row electrodes, and a signal voltage applied to each of the column electrodes, the method comprising the steps of: a) determining, for each of the column electrodes, correction data for correcting the signal voltage based on an increment or a decrement of an effective voltage value between each of row electrodes and each of the column electrodes; and b) applying a correction voltage for correcting the signal voltage to each of the column electrodes in accordance with the correction data. An increment or decrement of the effective voltage value may be due to i) at least either a blunt waveform or induced distortion of the signal voltage or ii) at least either a blunt waveform or induced distortion of the scanning voltage, or iii) both.

28 Claims, 16 Drawing Sheets

*FIG.5*

(Lateral position count value)

(Frame number)

| | 1 ~ 32 | 33~64 | | 161~192 | 193~224 | 225~256 | | 353~384 | 385~416 | 417~448 | | 545~576 | 577~608 | 609~640 | | 737~768 | 769~800 |
|---|---|---|---|---|---|---|---|---|---|---|---|---|---|---|---|---|---|
| Frame 1 | A1 | A2 | | A5 | A6 | A6 | | A8 | A9 | A9 | | A10 | A11 | A11 | | A11 | A12 |
| Frame 2 | A1 | A2 | | A5 | A6 | A6 | | A8 | A9 | A9 | | A10 | A11 | A11 | | A12 | A12 |
| Frame 3 | A1 | A2 | | A5 | A6 | A6 | | A8 | A9 | A9 | | A11 | A11 | A11 | | A12 | A12 |
| Frame 4 | A1 | A2 | ... | A5 | A6 | A7 | ... | A9 | A9 | A9 | ... | A11 | A11 | A11 | ... | A12 | A12 |
| Frame 5 | A1 | A2 | | A5 | A6 | A7 | | A9 | A9 | A9 | | A11 | A11 | A11 | | A12 | A12 |
| Frame 6 | A1 | A3 | | A6 | A6 | A7 | | A9 | A9 | A10 | | A11 | A11 | A11 | | A12 | A12 |
| Frame 7 | A1 | A3 | | A6 | A6 | A7 | | A9 | A9 | A10 | | A11 | A11 | A12 | | A12 | A12 |
| Frame 8 | A1 | A3 | | A6 | A6 | A7 | | A9 | A9 | A10 | | A11 | A11 | A12 | | A12 | A12 |

*FIG. 6*

28

(Induced distortion correction variable)

(Induced distortion count value)

| | A0 | A1 | A2 | A3 | A4 | A5 | A6 | A7 | A8 | A9 | A10 | A11 | A12 | A13 | A14 | A15 |
|---|---|---|---|---|---|---|---|---|---|---|---|---|---|---|---|---|
| 0～ | 0 | 0 | 0 | 0 | 0 | 0 | 0 | 0 | 0 | 0 | 0 | 0 | 0 | 0 | 0 | 0 |
| 64～ | 0 | 0 | 0 | 0 | 0 | 0 | 0 | 0 | 0 | 0 | 0 | 0 | 0 | 0 | 0 | 0 |
| 128～ | 0 | 0 | 0 | 0 | 0 | 0 | 0 | 0 | 1 | 1 | 1 | 1 | 1 | 1 | 1 | 1 |
| 192～ | 0 | 0 | 0 | 0 | 0 | 0 | 1 | 1 | 1 | 1 | 1 | 2 | 2 | 2 | 2 | 2 |
| 256～ | 0 | 0 | 0 | 0 | 1 | 1 | 1 | 1 | 2 | 2 | 2 | 2 | 3 | 3 | 3 | 3 |
| 320～ | 0 | 0 | 0 | 0 | 1 | 1 | 1 | 2 | 2 | 2 | 3 | 3 | 3 | 4 | 4 | 4 |
| 384～ | 0 | 0 | 0 | 1 | 1 | 1 | 2 | 2 | 3 | 3 | 3 | 4 | 4 | 4 | 5 | 5 |
| 448～ | 0 | 0 | 0 | 1 | 1 | 2 | 2 | 3 | 3 | 3 | 4 | 4 | 5 | 5 | 6 | 6 |
| 512～ | 0 | 0 | 1 | 1 | 2 | 2 | 3 | 3 | 4 | 4 | 5 | 5 | 6 | 6 | 7 | 7 |
| 578～ | 0 | 0 | 1 | 1 | 2 | 2 | 3 | 3 | 4 | 5 | 5 | 6 | 6 | 7 | 7 | 8 |
| 640～ | 0 | 0 | 1 | 1 | 2 | 3 | 3 | 4 | 5 | 5 | 6 | 6 | 7 | 8 | 8 | 9 |
| 704～ | 0 | 0 | 1 | 2 | 2 | 3 | 4 | 4 | 5 | 6 | 6 | 7 | 8 | 8 | 9 | 10 |
| 768～ | 0 | 0 | 1 | 2 | 3 | 3 | 4 | 5 | 6 | 6 | 7 | 8 | 9 | 9 | 10 | 11 |
| 832～ | 0 | 0 | 1 | 2 | 3 | 4 | 4 | 5 | 6 | 7 | 8 | 8 | 9 | 10 | 11 | 12 |
| 896～ | 0 | 0 | 1 | 2 | 3 | 4 | 5 | 6 | 7 | 7 | 8 | 9 | 10 | 11 | 12 | 13 |
| 960～ | 0 | 0 | 1 | 2 | 3 | 4 | 5 | 6 | 7 | 8 | 9 | 10 | 11 | 12 | 13 | 14 |
| 1024～ | 0 | 1 | 2 | 3 | 4 | 5 | 6 | 7 | 8 | 9 | 10 | 11 | 12 | 13 | 14 | 15 |
| 1088～ | 0 | 1 | 2 | 3 | 4 | 5 | 6 | 7 | 8 | 9 | 10 | 11 | 12 | 13 | 14 | 15 |
| 1152～ | 0 | 1 | 2 | 3 | 4 | 5 | 6 | 7 | 9 | 10 | 11 | 12 | 13 | 14 | 15 | 16 |
| 1216～ | 0 | 1 | 2 | 3 | 4 | 5 | 7 | 8 | 9 | 10 | 11 | 13 | 14 | 15 | 16 | 17 |
| 1280～ | 0 | 1 | 2 | 3 | 5 | 6 | 7 | 8 | 10 | 11 | 12 | 13 | 15 | 16 | 17 | 18 |
| 1344～ | 0 | 1 | 2 | 3 | 5 | 6 | 7 | 9 | 10 | 11 | 13 | 14 | 15 | 17 | 18 | 19 |
| 1408～ | 0 | 1 | 2 | 4 | 5 | 6 | 8 | 9 | 11 | 12 | 13 | 15 | 16 | 17 | 19 | 20 |
| 1472～ | 0 | 1 | 2 | 4 | 5 | 7 | 8 | 10 | 11 | 12 | 14 | 15 | 17 | 18 | 20 | 21 |
| 1536～ | 0 | 1 | 3 | 4 | 6 | 7 | 9 | 10 | 12 | 13 | 15 | 16 | 18 | 19 | 21 | 22 |
| 1600～ | 0 | 1 | 3 | 4 | 6 | 7 | 9 | 10 | 12 | 14 | 15 | 17 | 18 | 20 | 21 | 23 |
| 1664～ | 0 | 1 | 3 | 4 | 6 | 8 | 9 | 11 | 13 | 14 | 16 | 17 | 19 | 21 | 22 | 24 |
| 1728～ | 0 | 1 | 3 | 5 | 6 | 8 | 10 | 11 | 13 | 15 | 16 | 18 | 20 | 21 | 23 | 25 |
| 1792～ | 0 | 1 | 3 | 5 | 7 | 8 | 10 | 12 | 14 | 15 | 17 | 19 | 21 | 22 | 24 | 26 |
| 1856～ | 0 | 1 | 3 | 5 | 7 | 9 | 10 | 12 | 14 | 16 | 18 | 19 | 21 | 23 | 25 | 27 |
| 1920～ | 0 | 1 | 3 | 5 | 7 | 9 | 11 | 13 | 15 | 16 | 18 | 20 | 22 | 24 | 26 | 28 |
| 1984～ | 0 | 1 | 3 | 5 | 7 | 9 | 11 | 13 | 15 | 17 | 19 | 21 | 23 | 25 | 27 | 29 |
| 2048～ | 0 | 2 | 4 | 6 | 8 | 10 | 12 | 14 | 16 | 18 | 20 | 22 | 24 | 26 | 28 | 30 |
| 2112～ | 0 | 2 | 4 | 6 | 8 | 10 | 12 | 14 | 16 | 18 | 20 | 22 | 24 | 26 | 28 | 30 |
| 2176～ | 0 | 2 | 4 | 6 | 8 | 10 | 12 | 14 | 17 | 19 | 21 | 23 | 25 | 27 | 29 | 31 |
| 2240～ | 0 | 2 | 4 | 6 | 8 | 10 | 13 | 15 | 17 | 19 | 21 | 24 | 26 | 28 | 30 | 32 |
| 2304～ | 0 | 2 | 4 | 6 | 9 | 11 | 13 | 15 | 18 | 20 | 22 | 24 | 27 | 29 | 31 | 33 |
| 2368～2400 | 0 | 2 | 4 | 6 | 9 | 11 | 13 | 16 | 18 | 20 | 23 | 25 | 27 | 30 | 32 | 34 |

| Calculated correction amount (S208) | Correction data (S301) |
|---|---|
| 113 ~ | 113 |
| 105 ~ 112 | 105 |
| 97 ~ 104 | 97 |
| 89 ~ 96 | 89 |
| 81 ~ 88 | 81 |
| 73 ~ 80 | 73 |
| 65 ~ 72 | 65 |
| 57 ~ 64 | 57 |
| 49 ~ 56 | 49 |
| 41 ~ 48 | 41 |
| 33 ~ 40 | 33 |
| 25 ~ 32 | 25 |
| 17 ~ 24 | 17 |
| 9 ~ 16 | 9 |
| 0 ~ 8 | 0 |

*FIG. 12*

229

(Blunt waveform correction amount)

| n−1 \ n | V2 | V3 | V4 |
|---|---|---|---|
| V2 | 0 | −1 | 4 |
| V3 | 3 | 0 | 3 |
| V4 | 4 | −1 | 0 |

230

*FIG. 13*

(Correction period number)

(Lateral position count value)

| | 1Ho | 2Ho | 3Ho | 4Ho | 5Ho | 6Ho | 7Ho | 8Ho | Total |
|---|---|---|---|---|---|---|---|---|---|
| 1～32(dot) | 3 | 0 | 0 | 0 | 0 | 0 | 0 | 0 | 3 |
| 33～64 | 5 | 4 | 0 | 0 | 0 | 0 | 0 | 0 | 9 |
| 65～96 | 5 | 5 | 4 | 0 | 0 | 0 | 0 | 0 | 14 |
| 97～128 | 5 | 5 | 5 | 2 | 0 | 0 | 0 | 0 | 17 |
| 129～160 | 5 | 5 | 5 | 5 | 0 | 0 | 0 | 0 | 20 |
| 161～192 | 5 | 5 | 5 | 5 | 2 | 0 | 0 | 0 | 22 |
| 193～224 | 5 | 5 | 5 | 5 | 4 | 0 | 0 | 0 | 24 |
| 225～256 | 5 | 5 | 5 | 5 | 5 | 1 | 0 | 0 | 26 |
| 257～288 | 5 | 5 | 5 | 5 | 5 | 3 | 0 | 0 | 28 |
| 289～320 | 5 | 5 | 5 | 5 | 5 | 5 | 0 | 0 | 30 |
| 321～352 | 5 | 5 | 5 | 5 | 5 | 5 | 1 | 0 | 31 |
| 353～384 | 5 | 5 | 5 | 5 | 5 | 5 | 2 | 0 | 32 |
| 385～416 | 5 | 5 | 5 | 5 | 5 | 5 | 4 | 0 | 34 |
| 417～448 | 5 | 5 | 5 | 5 | 5 | 5 | 5 | 0 | 35 |
| 449～480 | 5 | 5 | 5 | 5 | 5 | 5 | 5 | 1 | 36 |
| 481～512 | 5 | 5 | 5 | 5 | 5 | 5 | 5 | 1 | 36 |
| 513～544 | 5 | 5 | 5 | 5 | 5 | 5 | 5 | 2 | 37 |
| 545～576 | 5 | 5 | 5 | 5 | 5 | 5 | 5 | 3 | 38 |
| 577～608 | 5 | 5 | 5 | 5 | 5 | 5 | 5 | 3 | 38 |
| 609～640 | 5 | 5 | 5 | 5 | 5 | 5 | 5 | 4 | 39 |
| 641～672 | 5 | 5 | 5 | 5 | 5 | 5 | 5 | 4 | 39 |
| 673～704 | 5 | 5 | 5 | 5 | 5 | 5 | 5 | 4 | 39 |
| 705～736 | 5 | 5 | 5 | 5 | 5 | 5 | 5 | 5 | 40 |
| 737～768 | 5 | 5 | 5 | 5 | 5 | 5 | 5 | 5 | 40 |
| 769～800 | 5 | 5 | 5 | 5 | 5 | 5 | 5 | 5 | 40 |

* 1Ho is a first correction period where eight correction periods consist of one cycle

LIQUID CRYSTAL DISPLAY DEVICE AND METHOD FOR DRIVING THE SAME

BACKGROUND OF THE INVENTION

1. Field of the Invention

The present invention relates to a matrix type super twisted nematic (STN) liquid crystal display device and a method for driving the device. The device and method are used in office automation equipment such as a personal computer and word processor, multi-media personal digital assistants, audio and video equipment, game machines, and the like. More particularly, the present invention relates to a liquid crystal display device and a driving method therefor which can improve display quality.

2. Description of the Related Art

Conventional STN liquid crystal display (LCD) devices have a problem that as display capacity, such as liquid crystal capacity is increased, display irregularity depending on display patterns emerges, leading to a significant decrease in display quality. Such display irregularity is called crosstalk.

An example of such crosstalk is one caused by induced distortion of scanning voltage (hereinafter referred to as "induced distortion crosstalk"). Specifically, when the waveforms of signal voltages applied to a number of column electrodes are simultaneously changed, a high level of induced distortion occurs in scanning voltage, so that an effective voltage value applied to each pixel is increased or decreased to be shifted from an intended effective voltage value.

FIG. 14A is a diagram used to briefly explain induced distortion crosstalk, showing a liquid crystal panel 140 including row electrodes Y1 through Y4 and column electrodes X1 through X4. When signal voltages SG1 through SG4 having waveforms shown in FIG. 14B are applied to the column electrodes X1 through X4 of FIG. 14A, induced distortion S1 through S4 occurs in the scanning voltage on the row electrode Y1 as shown in FIG. 14C. Similar induced distortion occurs in the scanning voltage on the row electrodes Y2 and Y3.

The magnitudes of induced distortion S1 through S4 occurring in the scanning voltage on the row electrode Y1 vary depending on the number of signal voltages SG1 through SG4 which are simultaneously changed. The more signal voltages simultaneously changed in the same direction, the larger the magnitudes. As shown in FIGS. 14B and 14C, when signal voltages which are changed in opposite directions cancel one another, smaller induced distortion occurs in a row electrode (S3 in FIG. 14C) as compared to when signal voltages are changed in the same direction (S1, S2 and S4 in FIG. 14C).

To solve the above-described problems, for example, Japanese Laid-Open Publication No. 6-27899 proposes a first conventional technique in which a change in voltage on a row electrode is detected and, in response to the change, a voltage on a column electrode is adjusted so that display irregularity is overcome.

Alternatively, Japanese Laid-Open Publication No. 11-84342 proposes a second conventional technique in which display data D(n) on an $n^{th}$ scanning line is compared to display data D(n−1) on an $(n-1)^{th}$ scanning line so that {M(HL)−M(LH)} is calculated where M(HL) is the number of data which transit from an H (High) level to an L (Low) level and M(LH) is the number of data which transit from the L level to the H level, and then a correction voltage having a magnitude and a direction corresponding to the calculation result is added from a column electrode to a signal voltage so as to correct the signal voltage.

Further, Japanese Laid-Open Publication No. 11-52326 proposes a third conventional technique in which a correction period equal to one or two horizontal scanning periods is inserted every a predetermined number of horizontal scanning periods.

Another type of crosstalk is now described. When the signal voltages SG1 through SG4 applied to the column electrodes X1 through X4 becomes "blunt" with respect to ideal waveforms due to resistance components of electrodes or capacity components of a liquid crystal layer in a liquid crystal panel, crosstalk (hereinafter referred to as "blunt waveform crosstalk") occurs.

There is also a phenomenon where there is a difference in brightness in the lateral direction of a screen independent of display patterns (hereinafter referred to as the "gradation phenomenon"). This is because a decrease in voltage occurs along a row electrode due to a resistance component of the row electrode and therefore a difference in an effective voltage value applied to a liquid crystal layer develops with respect to the lateral direction along the row electrode.

In fact, the above-described induced distortion crosstalk varies in a lateral direction along a row electrode due to both the capacity of a liquid crystal layer and the resistance of a row electrode.

FIG. 15 shows a difference in induced distortion crosstalk in a lateral direction along a row electrode. As shown in FIG. 15, for example, when the column electrodes X1 through X4 simultaneously transit from an H level to an L level, induced distortion V1 through V4 occurs in some row electrode Yn due to capacities C1 through C4 and resistances R1 through R4 of the row electrode Yn.

In this case, the resistances R1 through R4 are connected in series to the column electrodes X1 through X4, respectively. The magnitude of the above-described induced distortion is gradually increased toward the right side, i.e., the above-described induced distortion crosstalk becomes larger at the further right side of the row electrode Yn as shown in FIG. 15.

In the first conventional technique, the induced distortion crosstalk can be corrected. Such correction is performed in response to a change in voltage on a row electrode. In practice, the correction is only performed on a column-driver-by-column-driver basis where each column driver typically controls about 100 or more column electrodes. For this reason, differences in the induced distortion crosstalk in a lateral direction along a row electrode cannot be completely corrected. Thus, the above-described induced distortion crosstalk cannot be optimally corrected.

The second conventional technique makes an attempt to correct differences in induced distortion crosstalk in a lateral direction along a row electrode by digitally detecting the amount of the correction to be made. In practice, circuit scale is disadvantageously increased so that differences in the above-described induced distortion crosstalk can be corrected and smoothed. In order to perform the correction without an increase in circuit scale, the correction is only performed on a column-driver-by-column-driver basis. The differences in the induced distortion crosstalk in the lateral direction along a row electrode cannot be completely corrected. Similar to the first conventional technique, the induced distortion crosstalk cannot be optimally corrected. Moreover, since the correction is performed every horizontal scanning period, a large error is introduced to an optimal correction.

Further, in the third conventional technique, a correction period equal to one or two horizontal scanning periods is inserted every predetermined number of horizontal scanning periods. Therefore, a small error is only introduced to an optimal correction. However, the set pulse width or pulse amplitude of a correction voltage cannot be changed in small steps. Similar to the first and second conventional techniques, differences in induced distortion crosstalk in a lateral direction along a row electrode cannot be corrected, and therefore the induced distortion crosstalk cannot be corrected.

SUMMARY OF THE INVENTION

According to one aspect of the present invention, a method is provided for driving a liquid crystal display device including a plurality of row electrodes and a plurality of column electrodes, a scanning voltage being applied to each of the plurality of row electrodes, a signal voltage being applied to each of the plurality of column electrodes, and the plurality of row electrodes intersecting the plurality of column electrodes. The method comprises the steps of: a) determining, for each of the plurality of column electrodes, correction data for correcting the signal voltage based on an increment or decrement of an effective voltage value between each of the plurality of row electrodes and the plurality of column electrodes; and b) applying a correction voltage for correcting the signal voltage to each of the plurality of column electrodes in accordance with the correction data. An increment or decrement of the effective voltage value includes at least either of i) an increment or decrement of an effective voltage value due to at least either a blunt waveform or induced distortion of the signal voltage or ii) an increment or decrement of an effective voltage value due to at least either a blunt waveform or induced distortion of the scanning voltage.

In one embodiment of this invention, the correction voltage is applied to each of the plurality of column electrodes in a correction period, and the correction period equal to m horizontal scanning periods is provided in L horizontal scanning periods where L is an integer greater than or equal to 2 and m is an integer more than 0 and less than L.

In one embodiment of this invention, the correction data is determined based on a position of each of the plurality of column electrodes.

In one embodiment of this invention, step a) further comprises the step of: c) detecting a change in the signal voltage applied to each of the plurality of column electrodes as a digital amount and outputting the digital amount to each of the plurality of column electrodes.

In one embodiment of this invention, an increment or decrement of the effective voltage value is an increment or decrement of an effective voltage value due to induced distortion of the scanning voltage, and step c) further comprises the step of detecting, for each of the plurality of column electrodes, a change in the signal voltage based on a row driver control signal, and $n^{th}$ row display data and $(n-1)^{th}$ row display data.

In one embodiment of this invention, step c) further comprises the step of detecting a change in the signal voltage for each of the plurality of column electrodes, and calculating an induced distortion count value representing the total change in the signal voltage over all of the plurality of column electrodes.

In one embodiment of this invention, step a) further comprises the step of: d) calculating, for each of the plurality of column electrodes, an induced distortion correction amount based on the induced distortion count value and a lateral position count value representing a position of each of the plurality of column electrodes in a lateral direction along the plurality of row electrodes.

In one embodiment of this invention, step d) further comprises the steps of: calculating an induced distortion correction variable based on the lateral position count value and a frame number; and calculating the induced distortion correction amount based on the induced distortion correction variable and the induced distortion count value.

In one embodiment of this invention, the correction voltage is applied to each of the plurality of column electrodes in a correction period, and the correction period equal to m horizontal scanning periods is provided in L horizontal scanning periods where L is an integer greater than or equal to 2 and m is an integer more than 0 and less than L, and step a) further comprises the step of adding or subtracting an error between the correction data and the induced distortion correction amount, the correction data being applied to each of the plurality of column electrodes, to or from an induced distortion correction amount corresponding to a next correction period.

In one embodiment of this invention, an increment or decrement of the effective voltage value is an increment or decrement of an effective voltage value due to a blunt waveform of the scanning voltage, and step c) further comprises the step of detecting, for each of the plurality of column electrodes, a signal voltage change signal based on $n^{th}$ row display data and $(n-1)^{th}$ row display data.

In one embodiment of this invention, the signal voltage change signal includes an $n^{th}$ row signal voltage and an $(n-1)^{th}$ row signal voltage for each of the plurality of column electrodes.

In one embodiment of this invention, step c) further comprises the step of calculating a blunt waveform correction amount for correcting a blunt waveform of the scanning voltage based on the signal voltage change signal.

In one embodiment of this invention, step a) further comprises the step of calculating a gradation correction amount for correcting a gradation phenomenon based on a lateral position count value representing a position of each of the plurality of column electrodes in a lateral direction along the plurality of row electrodes.

In one embodiment of this invention, each correction voltage has a different pulse width.

In one embodiment of this invention, each correction voltage has a different pulse amplitude.

According to another aspect of the present invention, a liquid crystal display device includes a plurality of row electrodes and a plurality of column electrodes, a scanning voltage being applied to each of the plurality of row electrode, a signal voltage being applied to each of the plurality of column electrodes, and the plurality of row electrodes intersecting the plurality of column electrodes. The device further comprises: a correction operation circuit for determining, for each of the plurality of column electrodes, correction data for correcting the signal voltage based on an increment or decrement of an effective voltage value between each of the plurality of row electrodes and the plurality of column electrodes; and a column driver unit for applying a correction voltage for correcting the signal voltage to each of the plurality of column electrodes in accordance with the correction data. An increment or decrement of the effective voltage value includes at least either of i) an increment or decrement of an effective voltage value due to at least either a blunt waveform or induced distortion of the signal voltage or ii) an increment or decrement of an effective voltage value due to at least either a blunt waveform or induced distortion of the scanning voltage.

In one embodiment of this invention, the device further comprises a timing control circuit for providing a correction period, wherein the correction voltage is applied to each of the plurality of column electrodes in the correction period, and the correction period equal to m horizontal scanning periods is provided in L horizontal scanning periods where L is an integer greater than or equal to 2 and m is an integer more than 0 and less than L.

In one embodiment of this invention, the correction operation circuit determines the correction data based on a position of each of the plurality of column electrodes.

In one embodiment of this invention, the correction operation circuit comprises a column waveform change detection unit for detecting a change in the signal voltage applied to each of the plurality of column electrodes as a digital amount and outputting the digital amount to each of the plurality of column electrodes.

In one embodiment of this invention, an increment or decrement of the effective voltage value is an increment or decrement of an effective voltage value due to induced distortion of the scanning voltage, and the column waveform change detection unit detects, for each of the plurality of column electrodes, a change in the signal voltage based on a row driver control signal, and $n^{th}$ row display data and $(n-1)^{th}$ row display data.

In one embodiment of this invention, the correction operation circuit comprises a counter for detecting a change in the signal voltage for each of the plurality of column electrodes, and calculating an induced distortion count value representing the total change in the signal voltage over all of the plurality of column electrodes.

In one embodiment of this invention, the correction operation circuit comprises a correction amount look-up table for calculating, for each of the plurality of column electrodes, an induced distortion correction amount based on the induced distortion count value and a lateral position count value representing the position of each of the plurality of column electrodes in a lateral direction along the plurality of row electrodes.

In one embodiment of this invention, the correction amount look-up table comprises: a look-up table for calculating an induced distortion correction variable based on the lateral position count value and a frame number; and an induced distortion look-up table for calculating the induced distortion correction amount based on the induced distortion correction variable and the induced distortion count value.

In one embodiment of this invention, the correction voltage is applied to each of the plurality of column electrodes in a correction period, and the correction period equal to m horizontal scanning periods is provided in L horizontal scanning periods where L is an integer greater than or equal to 2 and m is an integer more than 0 and less than L, and the correction operation circuit further comprises an adder for adding or subtracting an error between the correction data and the induced distortion correction amount, the correction data being applied to each of the plurality of column electrodes, to or from an induced distortion correction amount corresponding to a next correction period.

In one embodiment of this invention, an increment or decrement of the effective voltage value is an increment or decrement of an effective voltage value due to a blunt waveform of the scanning voltage, and the column waveform change detection unit detects, for each of the plurality of column electrodes, a signal voltage change signal based on $n^{th}$ row display data and $(n-1)^{th}$ row display data.

In one embodiment of this invention, the signal voltage change signal includes an $n^{th}$ row signal voltage and an $(n-1)^{th}$ row signal voltage for each of the plurality of column electrodes.

In one embodiment of this invention, the correction operation circuit comprises a blunt waveform look-up table for calculating a blunt waveform correction amount for correcting a blunt waveform of the scanning voltage based on the signal voltage change signal.

In one embodiment of this invention, the correction operation circuit comprises a gradation look-up table for calculating a gradation correction amount for correcting a gradation phenomenon based on a lateral position count value representing the position of each of the plurality of column electrodes in a lateral direction along the plurality of row electrodes.

In one embodiment of this invention, each correction voltage has a different pulse width.

In one embodiment of this invention, each correction voltage has a different pulse amplitude.

Thus, the invention described herein makes possible the advantages of providing: (1) an LCD device and a driving method therefor for correcting and smoothing differences in induced distortion crosstalk in a lateral direction along a row electrode, in which, in the device and method of the present invention, the correction can be achieved without an increase in circuit scale and independent of column drivers and therefore, the induced distortion crosstalk can be optimally corrected with small errors and high precision; and (2) an LCD device and a driving method therefor for correcting the above-described induced distortion crosstalk and at the same time, optimally correcting blunt waveform crosstalk and a gradation phenomenon.

Hereinafter, functions of the present invention will be described.

In the present invention, a correction voltage for correcting a change in an effective voltage value caused by distortion of a scanning voltage waveform due to a change in signal voltage is applied to each column electrode in a correction period. In this case, the correction period which is equal to m horizontal scanning periods is provided in L horizontal scanning periods where L is an integer greater than or equal to 2 and m is an integer more than 0 and less than L. Thereby, display irregularity caused by the induced distortion crosstalk can be suppressed. Further, in the present invention, a means for generating a correction voltage which is varied every one or more column electrodes is provided. Therefore, differences in the induced distortion crosstalk in a lateral direction along row electrodes as well as the gradation phenomenon can be suppressed. Correction amounts corresponding to (L−m) horizontal scanning periods can be accumulated, thereby reducing a correction error.

Further, in the present invention, a means is provided for adding or subtracting an error between an increment or decrement of the correction voltage and an increment or decrement of an effective voltage value to or from a correction voltage which will be applied in the next correction period, thereby further improving the precision of correction.

Furthermore, in the present invention, a means for detecting a change in signal voltage applied to one of the column electrodes as a digital amount is provided, thereby detecting a bluntness amount of a signal voltage waveform due to a change in signal voltage. The blunt waveform crosstalk can be suppressed by performing correction corresponding to the bluntness amount in the blunt waveform crosstalk.

These and other advantages of the present invention will become apparent to those skilled in the art upon reading and understanding the following detailed description with reference to the accompanying figures.

BRIEF DESCRIPTION OF THE DRAWINGS

FIG. 5 is an example of an induced distortion look-up table of Example 1.

FIG. 6 is an example of an induced distortion correction table of Example 1.

FIG. 12 is an example of a blunt waveform look-up table of Example 2.

FIG. 13 is an example of a gradation look-up table of Example 2.

DESCRIPTION OF THE PREFERRED EMBODIMENTS

Hereinafter, the present invention will be described by way of illustrative examples with reference to the accompanying drawings.

EXAMPLE 1

An LCD device and a driving method therefor according to Example 1 of the present invention will be described below, in which induced distortion crosstalk is optimally corrected.

Figure 1A:
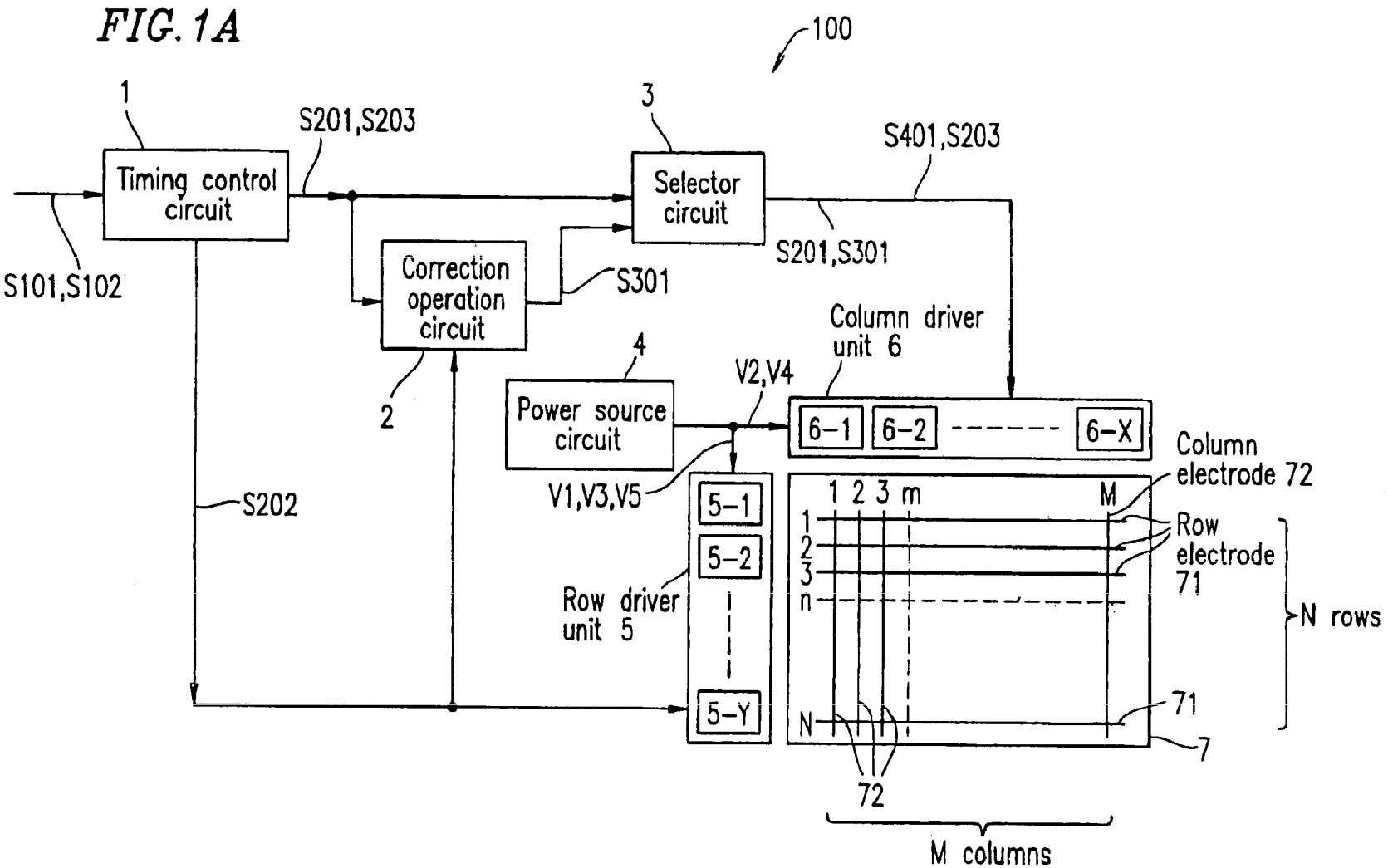
FIG. 1A is a diagram showing an example of an LCD device according to Example 1 of the present invention.
Figure 1B:
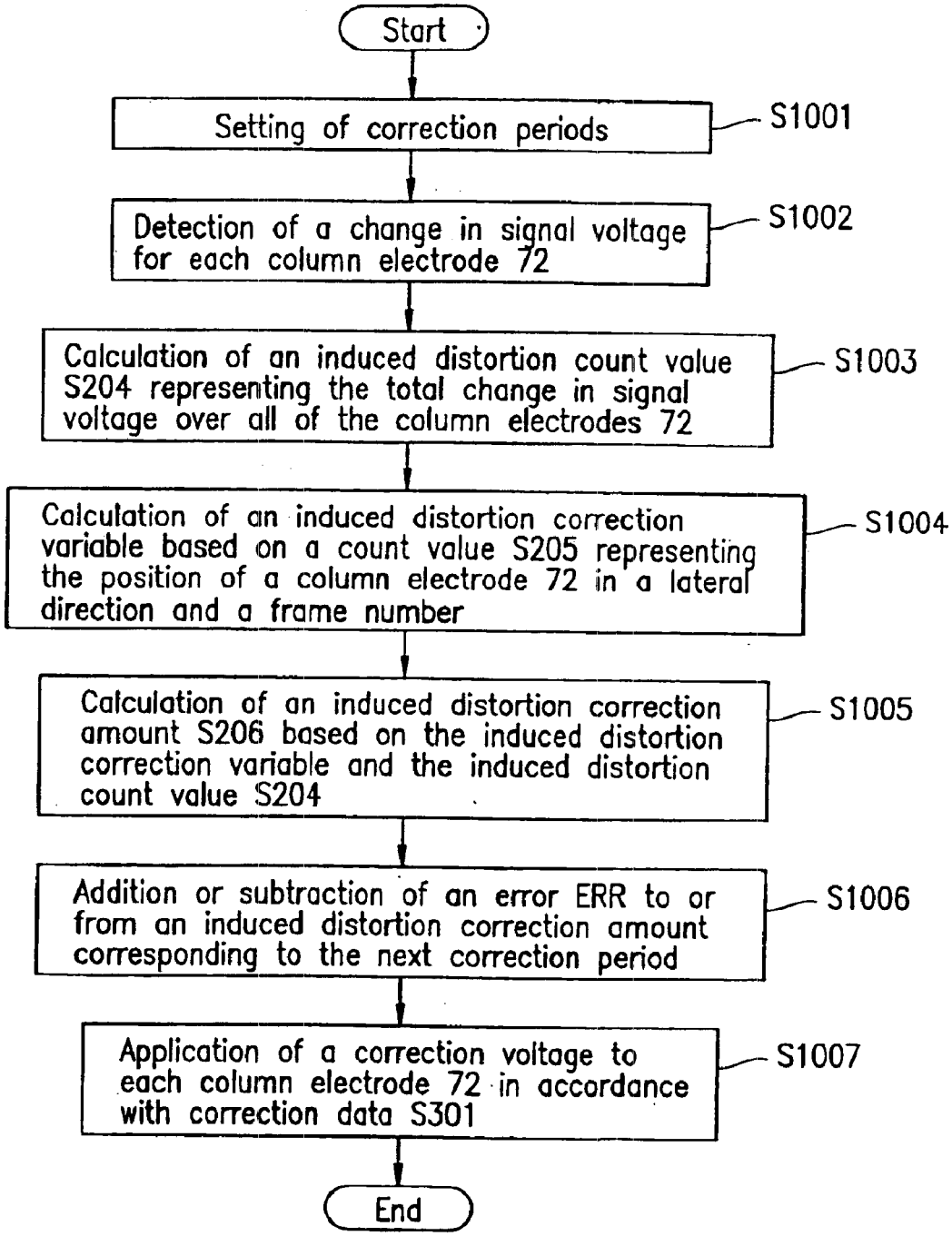
FIG. 1B is a flowchart showing an operation of the LCD device of Example 1.

FIG. 1A is a schematic diagram showing an LCD device 100 according to Example 1 of the present invention. FIG. 1B is a flowchart showing an operation of the LCD device 100. The LCD device 100 includes a timing control circuit 1, a correction operation circuit 2, a selector circuit 3, a power source circuit 4, a row driver unit 5, a column driver unit 6, and a liquid crystal panel 7.

The timing control circuit 1 controls the timing of the entire system of the LCD device 100. The timing control circuit 1 receives a synchronization signal S102 and display data S101 and outputs a column driver control signal S203, display data S201, and a row driver control signal S202.

The timing control circuit 1 also generates a correction period required for performing correction processing described below, and controls the correction operation circuit 2 and the selector circuit 3.

Further, the timing control circuit 1 controls the row driver unit 5 and, via the selector circuit 3, the column driver unit 6.

The correction operation circuit 2 receives the column driver control signal S203, the display data S201, and the row driver control signal S202 which are output from the timing control circuit 1. Then, the correction operation circuit 2 calculates an increment or decrement of an effective voltage value, which will be actually applied, from an effective voltage value which is intended to be applied to the liquid crystal panel 7. The correction operation circuit 2 determines correction data S301 which is appropriate for each column electrode 72 and outputs the correction data S301 to the selector circuit 3.

The selector circuit 3 receives the column driver control signal S203 and the display data S201 output from the timing control circuit 1 and the correction data S301 output from the correction operation circuit 2. In a display period, the selector circuit 3 switches between the display data S201 in a display period and the correction data S301 in a correction period. The display data S201 or the correction data S301 is output as a data signal S401 from the selector circuit 3 to the column driver unit 6. The selector circuit 3 also outputs the column driver control signal S203 to the column driver unit 6.

The power source circuit 4 generates voltages V1, V2, V3, V4, and V5 required for driving the row and column driver units 5 and 6. The voltages V1 and V5 are used as selection voltages in scanning row electrodes 71. The voltage V3 is used as a non-selection voltage in scanning the row electrodes 71 and as an off voltage corresponding to the correction data S301 applied to the column electrodes 72. The voltages V2 and V4 are used as on or off voltages corresponding to the display data S201 applied to the column electrodes 72, or on or off voltages corresponding to the correction data S301 applied to the column electrodes 72.

The row driver unit 5 includes a plurality of row drivers 5-1, 5-2, . . . , and 5-Y. Each of the row drivers 5-1, 5-2, . . . , and 5-Y is used to apply a progressive scanning voltage to the row electrodes 71 of the liquid crystal panel 7 in accordance with the row driver control signal S202 output from the timing control circuit 1.

The column driver unit 6 includes a plurality of column drivers 6-1, 6-2, . . . , and 6-X. Each of the column drivers 6-1, 6-2, . . . , and 6-X is used to apply a signal voltage to the column electrodes 72 of the liquid crystal panel 7 in accordance with the column driver control signal S203 and the data signal S401 output from the selector circuit 3.

The liquid crystal panel 7 is similar to one used in conventional LCD devices. The liquid crystal panel 7 includes N row electrodes 71, and M column electrodes 72 which are provided in such a manner as to intersect the row electrodes 71. The intersections are positioned in a matrix. A liquid crystal layer (not shown) is sandwiched between the row electrodes 71 and the column electrodes 72. Each intersection corresponds to a pixel. The liquid crystal layer at each pixel performs display in response to the effective voltage value of a driving voltage applied between one row electrode 71 and one column electrode 72.

Each circuit included in the LCD device 100 thus constructed will be described in more detail, where the liquid crystal panel 7 is of a SVGA type (800 columns×RGB×600 rows).

Figure 2:
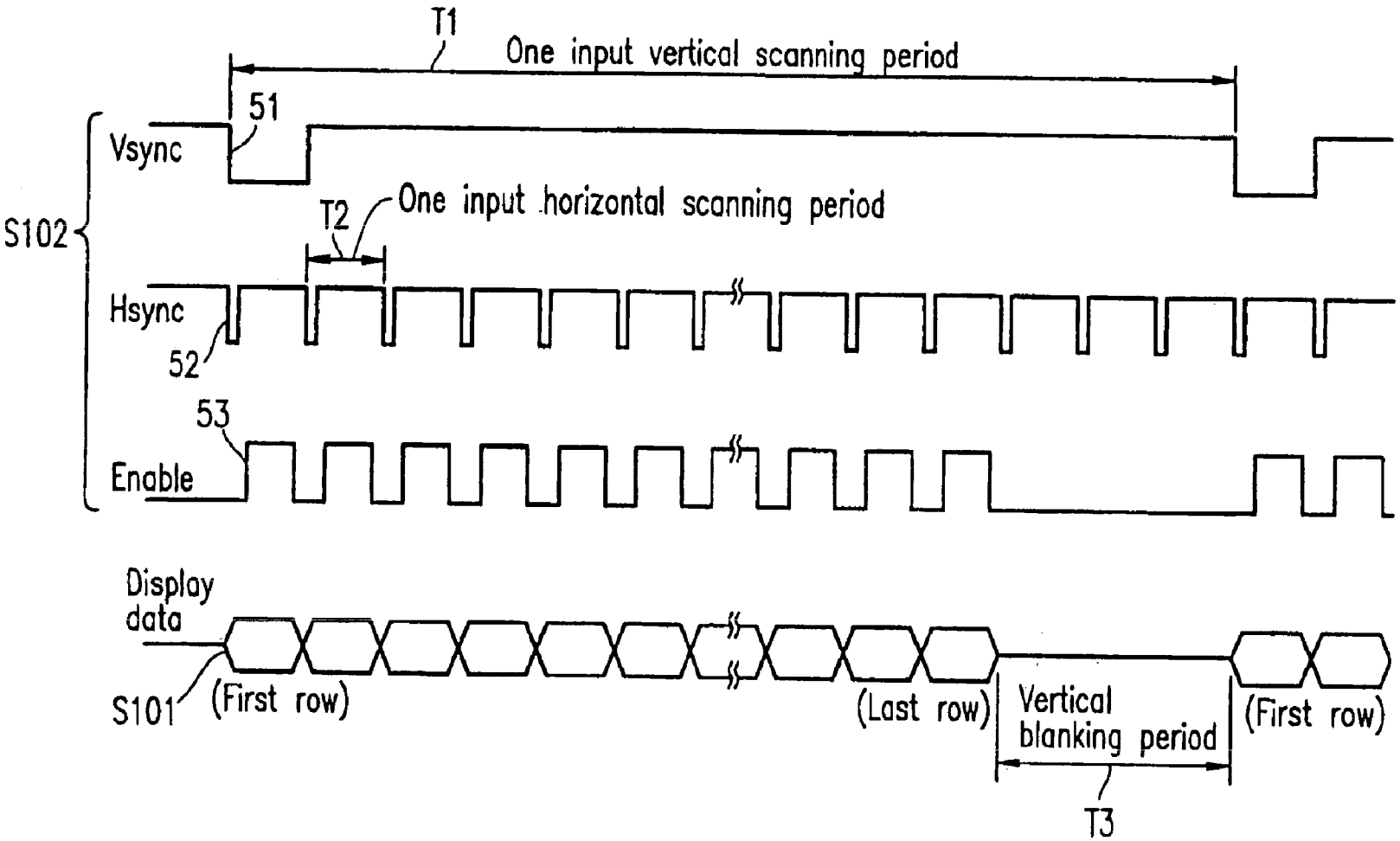
FIG. 2 is an input timing chart of a timing control circuit of Example 1.
Figure 3:
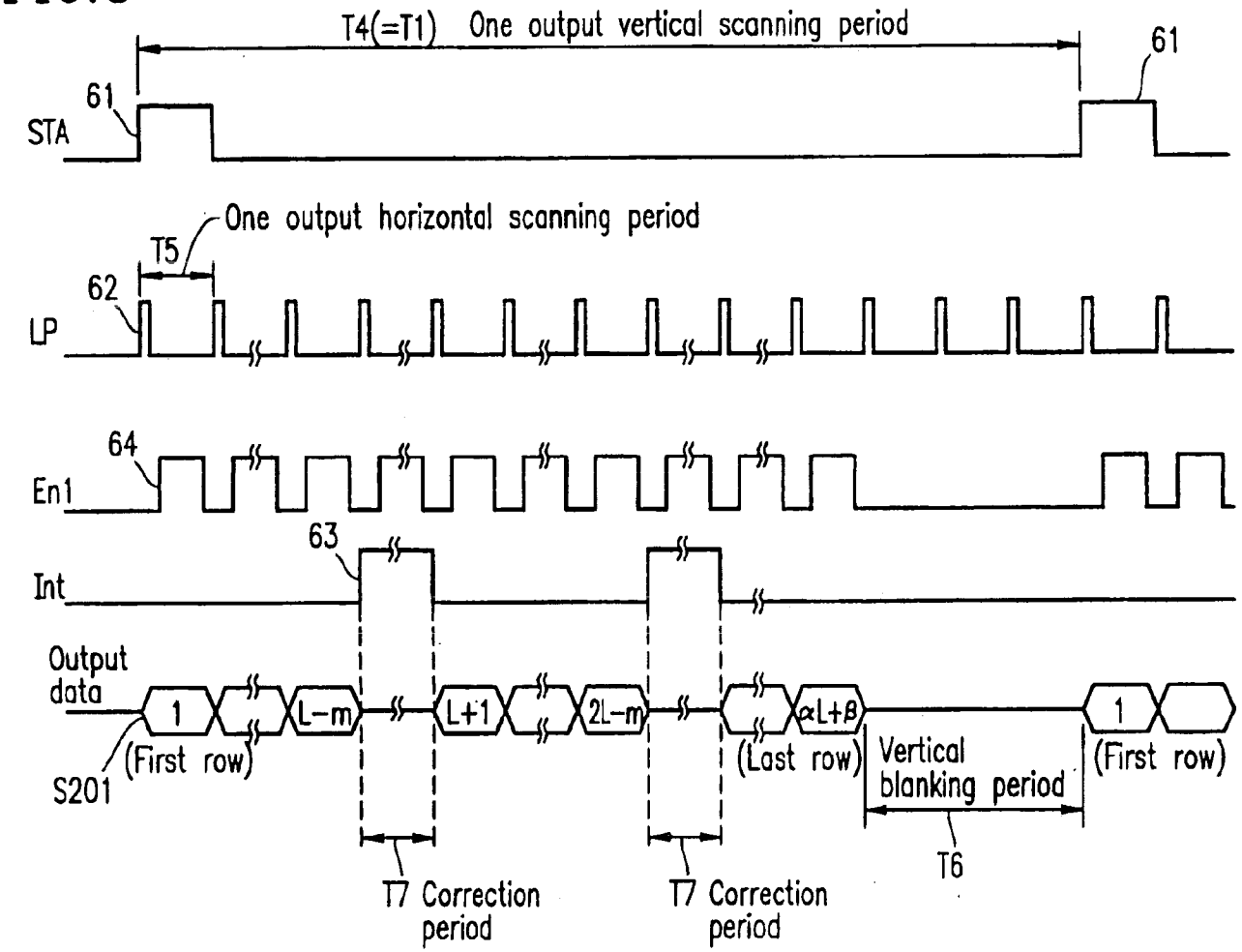
FIG. 3 is an output timing chart of a timing control circuit of Example 1.

FIGS. 2 and 3 are flowcharts showing an operation of the timing control circuit 1. In FIG. 2, the synchronization signal S102 and the display data S101 which are input to the timing control circuit 1 are shown. In FIG. 3, the column driver control signal S203 and the display data S201, which are output from the timing control circuit 1, are shown.

In FIG. 2, a Vsync signal 51 and an Hsync signal 52 indicate a vertical synchronization signal and a horizontal synchronization signal, respectively, which are input to the timing control circuit 1 along with the display data S101. One period of the Vsync signal 51 is called one input vertical scanning period T1, and one period of the Hsync signal 52 is called one input horizontal scanning period T2. As to the display data S101, R(Red), G(Green), and B(Blue) color data are input to the timing control circuit 1 and transferred to subsequent circuits on a pixel-by-pixel basis in parallel at the same timing.

An enable signal 53 indicates an effective period of the display data S101. The display data S101 is effective at the effective period during which the enable signal 53 is at a High level. The enable signal 53 is kept at the High level during a period of time which is required for scanning 800 column electrodes, in one input horizontal scanning period T2, and becomes the High level 600 times in one input vertical scanning period T1, so that the display data of 800 columns×RGB×600 rows is input to the timing control circuit 1. Apart of one input vertical scanning period T1, during which no effective data is input, is called a vertical blanking period T3.

In FIG. 3, an STA signal 61 is synchronized with the Vsync signal 51 (FIG. 2) and indicates the head of a frame. One period of the STA signal 61 is called one output vertical scanning period T4. In this case, one input vertical scanning period T1 (FIG. 2) is equal to one output vertical scanning period T4 (i.e., T1=T4).

An LP signal 62 is generated by reducing the period of the Hsync signal 52 (FIG. 2), which is a horizontal synchronization signal used in applying a signal voltage and a scanning voltage to the liquid crystal panel 7.

One period of the LP signal 62 is called one output horizontal scanning period T5. A correction period T7 which is equal to m horizontal scanning periods (where m is an integer more than 0 and less than L) is inserted to L output scanning periods T5 (where L is an integer greater than or equal to 2) (step S1001 shown in FIG. 1B). One output horizontal scanning period T5 is equal to one input horizontal scanning period T2 multiplied by ((L−m)/L).

An Int signal 63 is a signal indicating the inserted correction period T7. Specifically, a period during which the Int signal 63 is at a High level indicates each correction period T7. An En1 signal 64 is a signal indicating the effective periods of the display data S201 and correction data. Specifically, a period during which the En1 signal 64 is at a High level indicates each effective period. The En1 signal 64 is kept at the High level during a period of time which is required for scanning 800 column electrodes, in one output horizontal scanning period T5, becomes the High level 600 times in one output vertical scanning period T4, and becomes the High level the number of times a correction period is inserted, so that the display data S201 of 800 columns×RGB×600 rows and the correction data are output. A part of one output vertical scanning period T4, during which no display data S201 and no correction data are output, is called a vertical blanking period T6.

As described above, the timing control circuit 1 receives the synchronization signal S102 and the display data S101 (FIG. 2), and then generates the column driver control signal S203 and the display data S201 (FIG. 3) which are in turn output to the selector circuit 3. Assuming that one correction period having one output horizontal scanning period T5 is inserted into six output horizontal scanning periods T5, the description is continued below.

Figure 4:
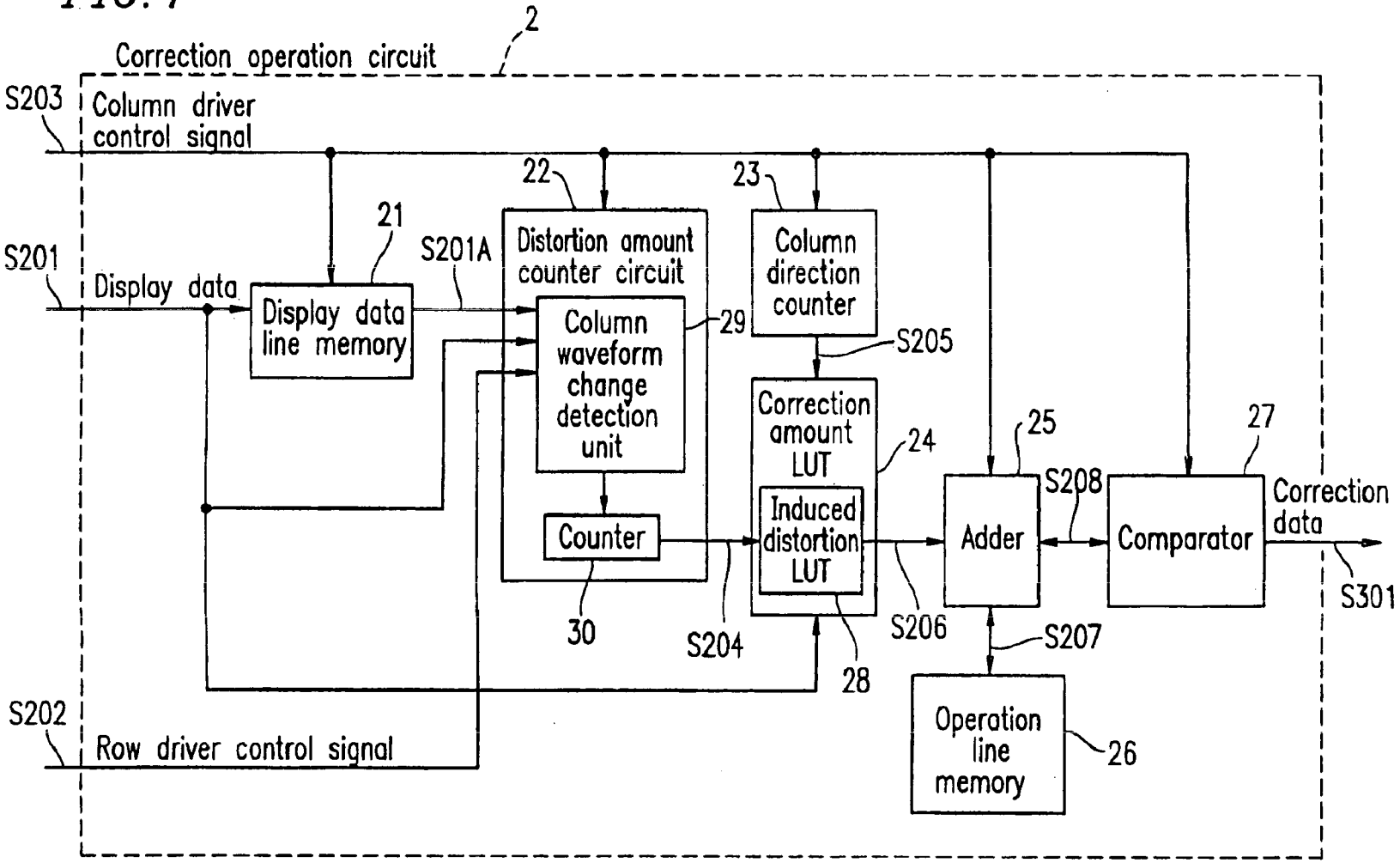
FIG. 4 is a structure of a correction operation circuit of Example 1.

Referring to FIG. 4, the correction operation circuit 2 includes a display data line memory 21, a distortion amount counter circuit 22, a column direction counter 23, a correction amount look-up table (LUT) 24, an adder 25, an operation line memory 26, and a comparator 27.

The display data line memory 21 stores the display data S201 for an $n^{th}$ row, and outputs display data S201A for an $(n-1)^{th}$ row, which has been stored one output horizontal scanning period T5 before, to the distortion amount counter circuit 22.

The distortion amount counter circuit 22 receives the row driver control signal S202, the display data S201 for the $n^{th}$ row, and the display data S201A for the $(n-1)^{th}$ row. In the distortion amount counter circuit 22, a column waveform change detection unit 29 sequentially detects changes in signal voltage which will be eventually applied to the liquid crystal panel 7 between the $(n-1)^{th}$ row and the $n^{th}$ row for each column electrode 72, based on the display data S201 for the $n^{th}$ row and the display data S201A for the $(n-1)^{th}$ row (S1002 shown in FIG. 1B). A counter 30 also included in the distortion amount counter circuit 22 calculates the total change in signal voltage over all of the column electrodes 72, and outputs the result as an induced distortion count value S204 to the correction amount LUT 24 (S1003 shown in FIG. 1B).

Specifically, for example, it is assumed that out of 800 columns×RGB, on 300 columns×RGB the signal voltages are changed from the voltage V2 to the voltage V4, on 100 columns×RGB the signal voltages are changed from the voltage V4 to the voltage V2, on 250 columns×RGB the signal voltages are not changed from the voltage V2, and on 150 columns×RGB the signal voltages are not changed from the voltage V4. In this case, the induced distortion count value S204 is equal to +600 (=+1×(300×3)−1×(100×3)+0×(250×3)+0×(150×3)), where signs + and − represent the direction of the changes in signal voltages, and where +1 is equal to a change from the signal voltage V2 to the signal voltage V4, and −1 is equal to a change from the signal voltage V4 to the signal voltage V2.

Induced distortion occurs in the scanning voltage, depending on the total change in signal voltages on all of the column electrodes 72. Therefore, the induced distortion count value S204 obtained by the distortion amount counter circuit 22 represents the amount of induced distortion in the scanning voltages.

The column direction counter 23 counts the number of column electrodes 72 in a lateral direction along the row electrodes 71, and outputs the resultant count value S205 to the correction amount LUT 24. In other words, the count value S205 represents the position of a column electrode 72 in the lateral direction.

The correction amount LUT 24 receives the induced distortion count value S204 output from the distortion amount counter circuit 22 and the lateral count value S205 output from the column direction counter 23 and, for each column electrode, determines an induced distortion correction amount S206 corresponding to the increment or decrement of an effective voltage value, based on an induced distortion look-up table (induced distortion LUT) 28. The operation of the correction amount LUT 24 will be described with reference to FIGS. 5, 6, and 7.

FIG. 5 shows a table used for selecting an induced distortion correction variable in accordance with the count value S205 representing the position of each column electrode 72 in the lateral direction along the row electrodes 71. In the table of FIG. 5, vertical terms indicate frame numbers, horizontal items indicate the count values S205, and their intersections indicate the induced distortion correction variables to be selected. A count value S205 of "1" indicates the leftmost column electrode 72 of the liquid crystal panel 7, and a count value S205 of "800" indicates the rightmost column electrode 72 of the liquid crystal panel 7.

As shown in FIG. 5, the count values S205 range from "1" to "800", including 25 steps of 32 columns×RGB (here RGB counted as one). The frame number ranges from "1" to "8". Any one of the induced distortion correction variables A0 through A15 is allocated to a set of each step of the count values S205 and each frame (S1004 shown in FIG. 1B). In this case, it is assumed that the row driver unit 5 (FIG. 1A) is provided at the left side of the liquid crystal panel 7. Therefore, as the count value S205 is increased, the induced distortion correction amount S206 corresponding to the induced distortion correction variable is also increased. In other words, the induced distortion correction variables are designed so that the induced distortion correction amount S206 is increased toward the right side of the liquid crystal panel 7.

In this case, although there are only 16 steps A0 through A15 among the induced distortion correction variables, eight different sets of the induced distortion correction variables are periodically used on a frame-by-frame basis (one frame= one vertical scanning period). Therefore, the temporal average of the induced distortion correction amount can vary over about 100 or more steps, leading to smooth correction.

FIG. 6 shows the induced distortion LUT 28 for correcting the increment or decrement of an effective voltage value due to induced distortion. In FIG. 6, vertical items indicate the induced distortion count values S204, the horizontal items indicate induced distortion correction variables, and their intersections indicates induced distortion correction amounts S206 determined for each column electrode 72.

As shown in FIG. 6, the induced distortion count value S204 ranges from 0 to 2400 (=800 dots×RGB), including 38 steps of 64. The induced distortion correction variable ranges from A0 to A15, including 16 steps. An induced distortion correction amount S206 is allocated to a set of each step of the induced distortion count value and each of the induced distortion correction variables A0 through A15 (S1005 shown in FIG. 1B). In the induced distortion LUT 28, the induced distortion correction amounts S206 are increased as the induced distortion count value is increased.

In the induced distortion LUT 28, the induced distortion correction values S206 are represented as absolute values having no signs. Whether the induced distortion correction values S206 are added or subtracted is determined in accordance with the increment or decrement of the effective voltage value for each column electrode 72.

Figures 7, 8:
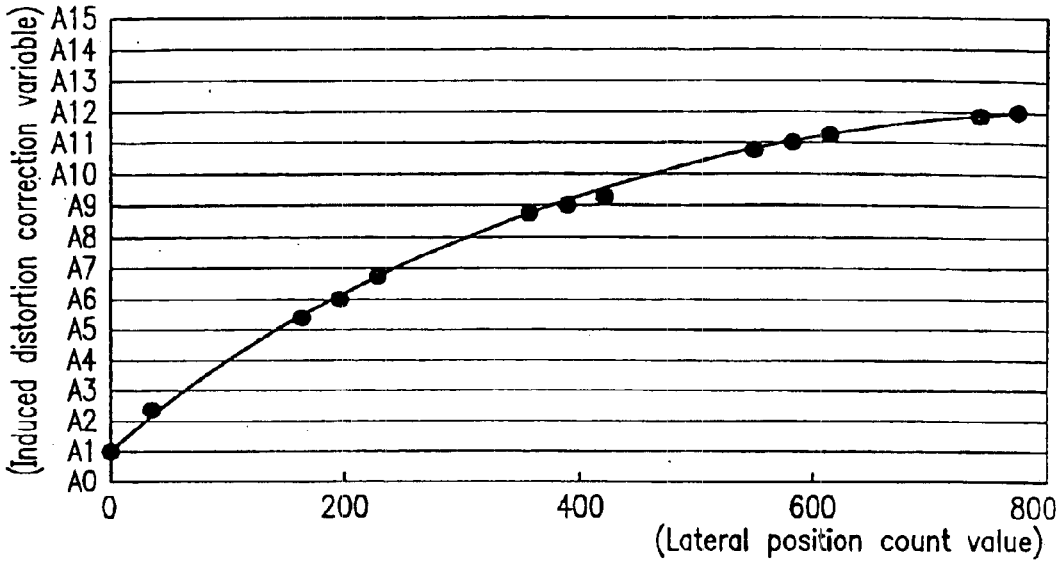
FIG. 7 is a graph of induced distortion correction variable (vertical axis) versus count value representing the position of each column electrode in a lateral direction along row electrodes (horizontal axis) in the LCD device of Example 1.
FIG. 8 is a table showing a data conversion which is performed in a comparator of Example 1.

FIG. 7 is a graph of the induced distortion correction variable (vertical axis) versus the count value S205 representing the positions of a column electrode 72 in the lateral direction along a row electrode (horizontal axis). Although the induced distortion correction variables only ranges over 16 steps, i.e., from A0 to A15, the temporal average of the induced distortion correction variables over eight frames exists between the induced distortion correction variables as shown in FIG. 7. Such values lead to smooth correction with respect to the lateral direction.

As described above, the induced distortion correction amount S206 for each column electrode 72 is determined in each horizontal scanning period in the correction amount LUT 24 and can correspond to the increment or decrement of an effective voltage value. The induced distortion correction amount S206 is output to the adder 25.

The adder 25 receives the induced distortion correction amount S206 for each column electrode 72 and a previous correction amount S207 which has been stored in the operation line memory 26. Both the correction amounts S206 and S207 are added or subtracted together, and the result is stored in the operation line memory 26 as the previous correction amount S207.

During five horizontal scanning periods other than one horizontal scanning period provided as the correction period T7 among six horizontal scanning periods, a calculated correction amount is stored as it is in the operation line memory 26 as the calculated correction amount S207. During the correction period T7, a calculated correction amount is not transferred as it is to the operation line memory 26. However, the calculated correction amount is transferred as a calculated correction amount S208 to the comparator 27 before being stored in the operation line memory 26.

FIG. 8 is a table showing data conversion which is performed in the comparator 27. The left column indicates the calculated correction amounts S208 (FIG. 4) output from the adder 25. The right column indicates the correction data S301 (FIG. 5) which is applied to each column electrode 72 of the liquid crystal panel 7 via the column driver unit 6. In the comparator 27, the calculated correction amount S208 received is converted into the correction data S301. The correction data S301 is classified into 15 steps. A correction voltage having a different pulse width is applied to each column electrode 72 based on the correction data S301. An error ERR between the calculated correction amount S208 and the correction data S301, which occurs in the conversion, is stored in the operation line memory 26 via the adder 25. For example, when the calculated correction amount S208 is "60", the corresponding correction data S301 is "57". The difference of "3" between "60" and "57" is stored as the error ERR in the operation line memory 26 via the adder 25. The error ERR is added to or subtracted from the induced distortion correction amount S206 (S1006 shown in FIG. 1B).

In this way, the correction operation circuit 2 generates the correction data S301 for each column electrode 72, and outputs the correction data S301 to the selector circuit 3.

The selector circuit 3 switches between the received display data S201 and correction data S301 in accordance with the Int signal 63 (FIG. 3), and outputs the exclusively selected data to the column driver unit 6. For example, when the Int signal 63 is at the Low level, the display data S201 is output to the column driver unit 6 during the High level period of the En1 signal 64. When the Int signal 63 is at the High level, the correction data S301 is output to the column driver unit 6 in the High level period of the En1 signal 64.

At the same time, the column driver control signal generated by the timing control circuit 1 is also output to the column driver unit 6.

Figure 9:
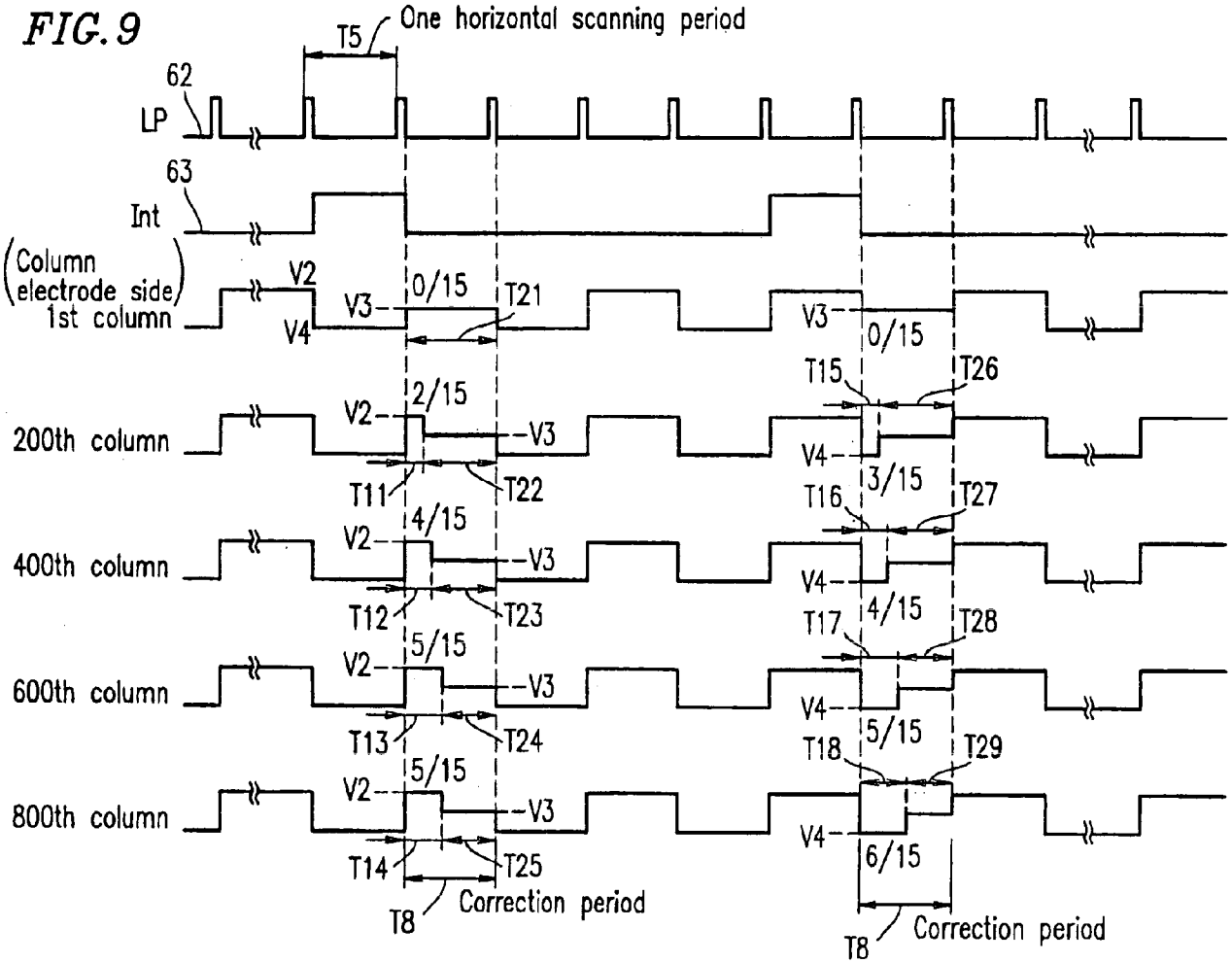
FIG. 9 is a timing chart showing a waveform of a signal voltage applied to a column electrode in Example 1.

FIG. 9 is a timing chart showing the waveform of a signal voltage applied to each column electrode 72. In FIG. 9, an LP signal 62 and an Int signal 63 are signals for controlling the column drivers. As described above, when the Int signal 63 is in the Low period, the display data S201 is transferred to the column drivers. When the Int signal 63 is in the High period, the correction data S301 for each column electrode 72 is transferred to the column drivers. In the column drivers, the overall correction data S301 which have been transferred in one horizontal scanning period T5 are simultaneously applied to the respective column electrodes 72 in the correction period T8, in synchronization with the rising of the next LP signal 62.

FIG. 9 shows the waveforms of signal voltages applied to the column electrodes 72 at different positions in the lateral direction. Even when some signal voltages have the same waveforms in the display period, the signal voltages have correction voltages having different pulse widths which are applied to the respective column electrodes 72 in the correction period T8. The pulse widths of the correction voltages are optimally adjusted, depending on the positions in the lateral direction along the row electrodes 71. In the correction period T8, periods T11 through T14 are ones in which the signal voltage V2 is applied to the column electrodes 72. Further, in the correction period T8, periods T15 through T18 are ones in which the signal voltage V4 is applied to the column electrodes 72. In those periods, the effective voltage value is increased. In the correction period T8, periods T21 through T29 are ones during which the signal voltage V3 is applied to the column electrodes 72. In those periods, the effective voltage value is not increased or decreased. Therefore, when the periods T11 through T14 in which the signal voltage V2 is applied to the column electrodes 72 and the periods T15 through T18 in which the signal voltage V4 is applied to the column electrodes 72 are variable for each column electrode 72, the correction voltage can be optimized.

When the optimized correction voltage is applied to each column electrode 72 in the thus designed correction period, the induced distortion crosstalk can be smoothed and corrected optimally.

Since one horizontal scanning period is provided as the correction period T7 in six horizontal scanning periods, the overall correction amounts for five horizontal scanning periods can be converted together to correction data. Therefore, error can be reduced as compared with when correction is performed every horizontal scanning period.

In the foregoing, the correction period which is equal to one horizontal scanning period is provided every six horizontal scanning periods. Alternatively, the correction period T7 which is equal to arbitrary m horizontal scanning periods may be provided every arbitrary L horizontal scanning periods. The correction voltages have different pulse widths corresponding to respective correction amounts. Alternatively, the correction voltages have different pulse amplitudes corresponding to respective correction amounts. As to the induced distortion LUT 28, the correction amounts corresponding to the induced distortion count values are determined using the 16 induced distortion variables A0 through A15. An arbitrary number of induced distortion variables may be used. In the foregoing, 800 columns×RGB are divided into 25 regions each having 32 columns×RGB, and eight different sets of the induced distortion correction variables which are applied to such regions depending on the lateral direction along the row electrodes 71 are periodically used on a frame-by-frame basis. Alternatively, an arbitrary number of regions and an arbitrary number of frames may be used. Further, the present invention is not limited to a liquid crystal panel having a pixel structure of a SVGA type (800 columns×RGB×600 rows).

EXAMPLE 2

Next, an LCD device and a driving method therefor according to Example 2 of the present invention will be described below. The LCD device of Example 2 has the same structure as that of Example 1 and further includes circuits which optimally correct blunt waveform crosstalk and the gradation phenomenon while correcting induced distortion crosstalk.

Blunt waveform crosstalk depends on at least either a change in signal voltage or a change in scanning voltage, but is independent of the position of each column electrode 72 in the lateral direction along the row electrodes 71 (FIG. 1A). The gradation phenomenon depends on the position of each column electrode 72 in the lateral direction, but is independent of a change in signal voltage.

In Example 1, the induced distortion crosstalk depends on at least either a change in signal voltage or a change in scanning voltage as well as the position of each column electrode 72 in the lateral direction. Therefore, the circuit for correcting the induced distortion crosstalk can also be used to correct both blunt waveform crosstalk and the gradation phenomenon.

Figure 10A:
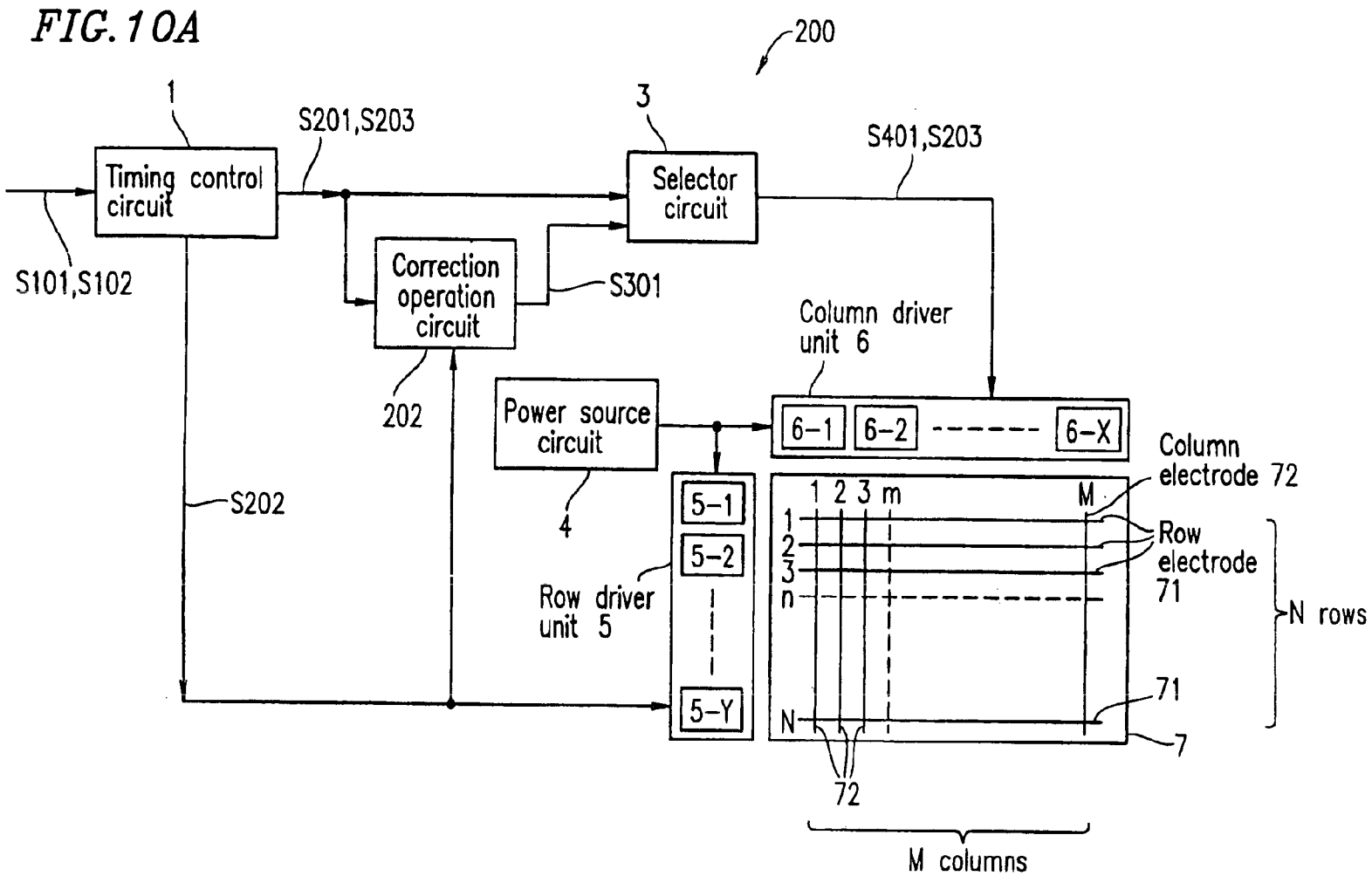
FIG. 10A is a diagram showing an example of an LCD device according to Example 2 of the present invention.
Figure 10B:
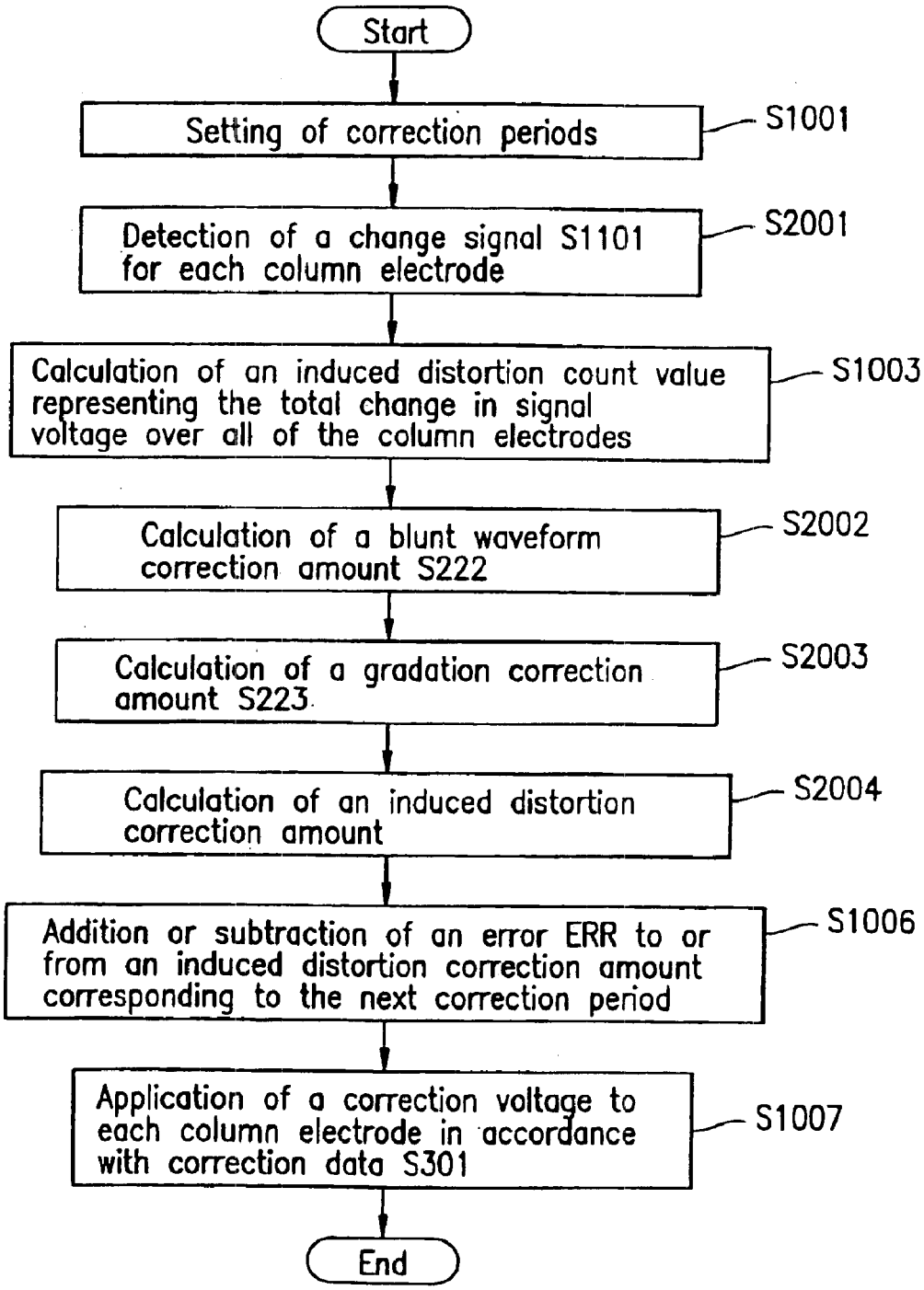
FIG. 10B is a flowchart showing an operation of the LCD device of Example 2.
Figure 11:
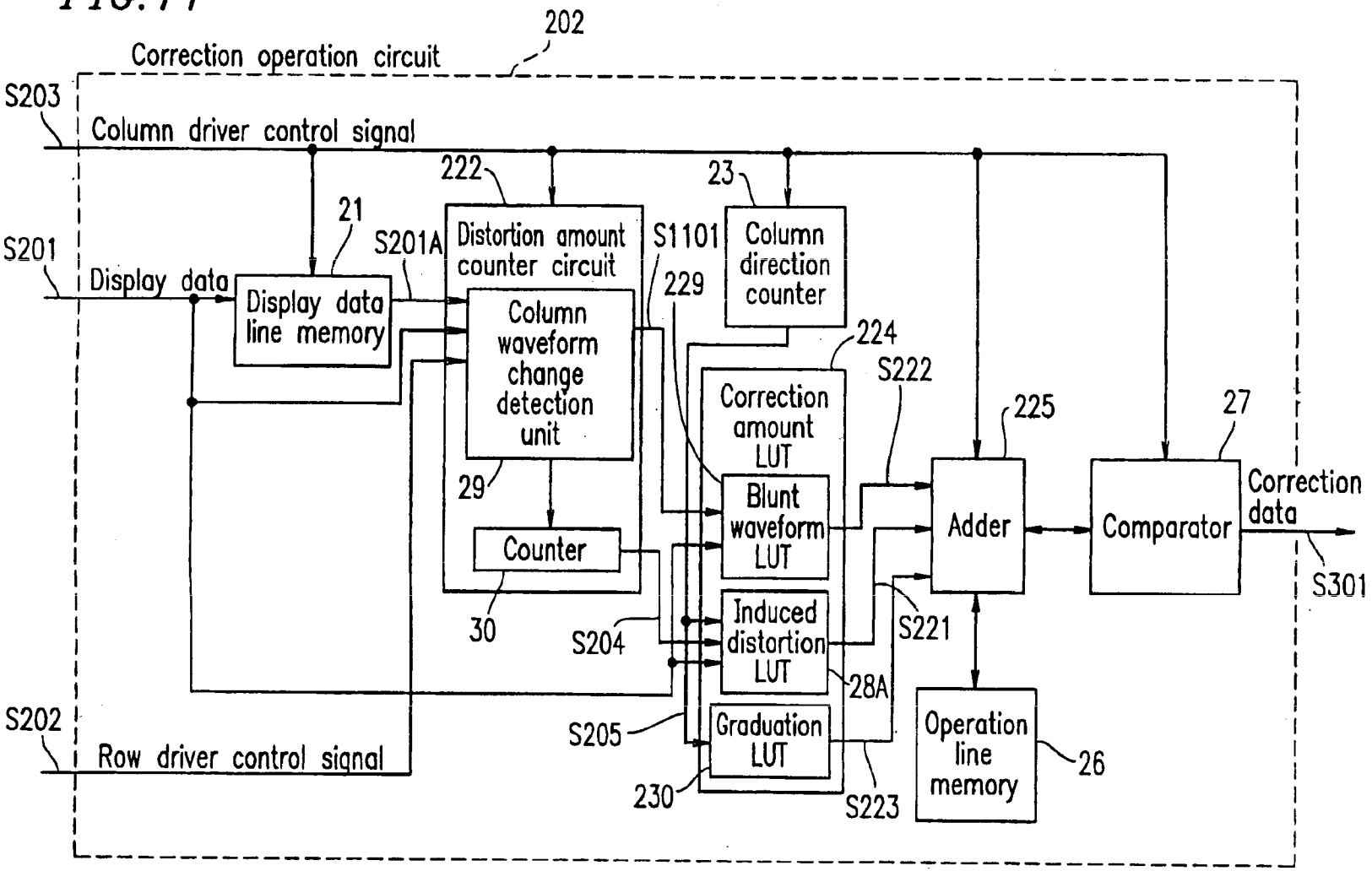
FIG. 11 is a structure of a correction operation circuit of Example 2.
Figure 14A:
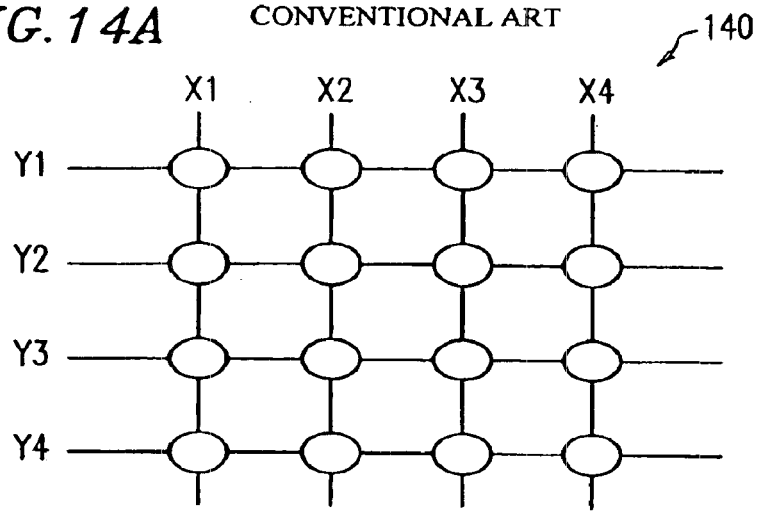
FIG. 14A CONVENTIONAL ART
FIGS. 14A, 14B, and 14C are diagrams used to explain a cause for crosstalk in a conventional LCD device.
Figure 14B:
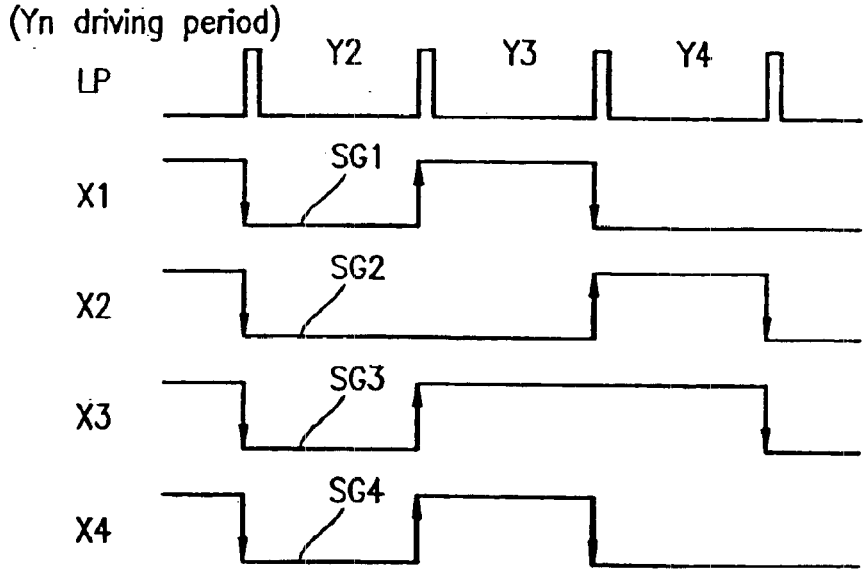
FIG. 14B CONVENTIONAL ART
Figure 14C:
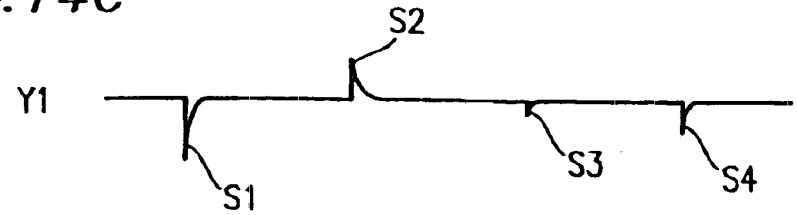
FIG. 14C CONVENTIONAL ART
Figure 15:
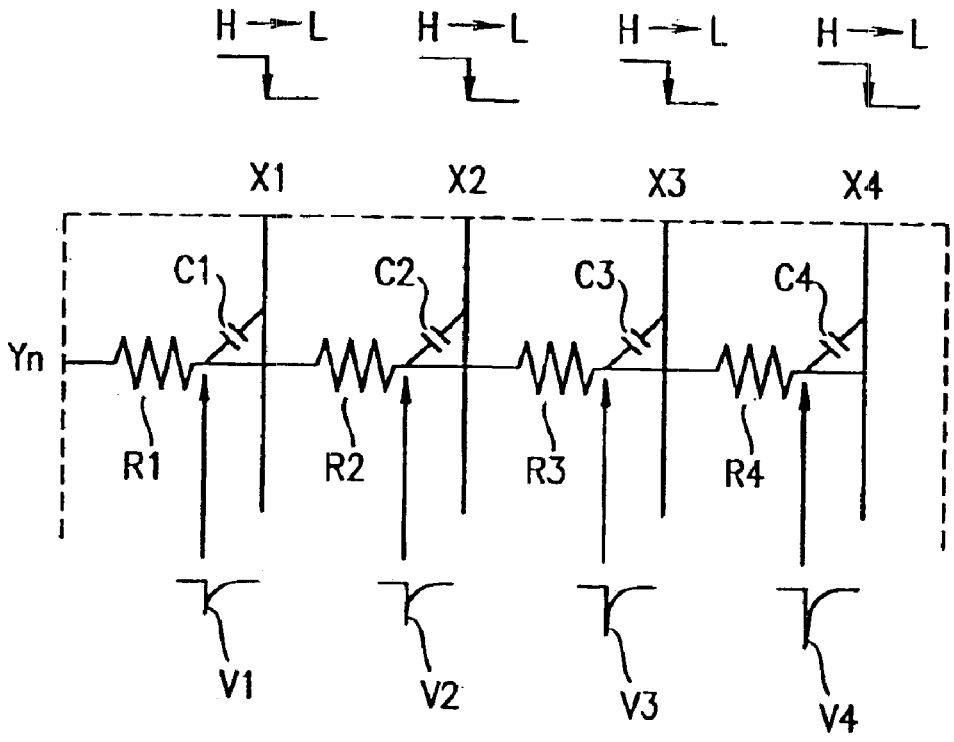
FIG. 15 CONVENTIONAL ART
FIG. 15 is a diagram used to explain a cause for crosstalk in a conventional LCD device.

In Example 2, as shown in FIGS. 10A and 11, the correction operation circuit 2 further includes circuits in addition to the structure of Example 1 of FIGS. 1A and 4. In other respects, the LCD device of Example 2 is the same as that of Example 1. FIG. 10B is a flowchart showing an operation of an LCD device 300 of Example 2. Hereinafter, only differences with Example 1 will be described.

Referring to FIG. 11, a correction operation circuit 202 of Example 2 includes a display data line memory 21, a distortion amount counter circuit 222, a column direction counter 23, a correction amount LUT 224, an adder 225, an operation line memory 26, and a comparator 27. In contrast to the correction operation circuit 2 of Example 1 according to FIG. 4, the distortion amount counter circuit 222, the correction amount LUT 224, and the adder 225 are modified. In other respects, the correction operation circuit 202 is the same as that of Example 1.

Initially, a corrected period is provided in a manner similar to that of Example 1 (S1001 shown in FIG. 10B). The distortion amount counter circuit 222 is the same as that of Example 1 from a viewpoint of structure. The difference from Example 1 is that the distortion amount counter circuit 222 outputs a signal to the correction amount LUT 224. Specifically, the distortion amount counter circuit 222 receives a row driver control signal S202, and the display data S201 for the $n^{th}$ row and the display data S201A for the $(n-1)^{th}$ row. Based on the display data S201 for the $n^{th}$ row and the display data S201A for the $(n-1)^{th}$ row, the column waveform change detection unit 29 sequentially detects a change in signal voltages from the $n^{th}$ row to the $(n-1)^{th}$ row for each column electrode 72 (FIG. 10A), and outputs the results as a signal voltage change signal S1101 to the correction amount LUT 224 (S2001 shown in FIG. 10B). The counter 30 calculates the total of changes in signal voltages in all of the column electrodes 72 (FIG. 10A), and outputs the result as an induced distortion count value S204 to the correction amount LUT 224 (S1003 shown in FIG. 10B).

The correction amount LUT 224 further includes a blunt waveform LUT 229 and a gradation LUT 230, in addition to an induced distortion LUT 28A as described in Example 1. The induced distortion LUT 28A is used for correcting the increment or decrement of an effective voltage value due to induced distortion. The blunt waveform LUT 229 is used for correcting the increment or decrement of an effective voltage value due to a blunt waveform. The gradation LUT 230 is used for correcting the increment or decrement of an effective voltage value due to the gradation phenomenon.

FIG. 12 shows the blunt waveform LUT 229 for correcting the increment or decrement of an effective voltage value due to a blunt waveform. In the blunt waveform LUT 229 of FIG. 12, a vertical item indicates an $(n-1)^{th}$ signal voltage, and a horizontal item indicates an $n^{th}$ signal voltage. The intersection of a vertical item and a horizontal item indicates a blunt waveform correction amount S222 (FIG. 11). For example, when a signal voltage applied to a column electrode 72 is changed from V2 to V4, a blunt waveform correction amount S222 for the column electrode 72 is determined as "4" (S2002 shown in FIG. 10B).

FIG. 13 shows the gradation LUT 230 for correcting the increment or decrement of an effective voltage value due to the gradation phenomenon. In the gradation LUT 230 of FIG. 13, a vertical item indicates a count value S205 representing the position of a column electrode 72 (FIG. 10A) in the lateral direction along the row electrodes 71, and a horizontal item indicates a correction period number. The intersection of a vertical item and a horizontal item indicates a gradation correction amount S223 (FIG. 11). A count value S205 of "1" indicates the leftmost column electrode 72 of the liquid crystal panel 7, and a count value S205 of "800" indicates the rightmost column electrode 72 of the liquid crystal panel 7.

As shown in FIG. 13, the count values S205 range from "1" to "800", including 25 steps of 32 columns×RGB (here RGB counted as one). The correction period number ranges from "1Ho" to "8Ho". The intersection of a step of the count values S205 and a correction period number indicates a gradation correction amount (S2003 shown in FIG 10B). In this case, it is assumed that the row driver unit 5 (FIG. 1A) is provided at the left side of the liquid crystal panel 7. Therefore, as the count value S205 is increased, the gradation correction amount S223 is also increased. In other words, the gradation correction amounts S223 are designed so as to be increased toward the right side of the liquid crystal panel 7.

In this case, eight different sets of gradation correction amounts for the count values S205 are periodically used on a correction-period-by-correction-period basis. Therefore, the temporal average of the gradation correction amounts can vary in smaller steps, leading to smooth correction.

The increment or decrement of an effective voltage value due to the gradation phenomenon is smaller than the increment or decrement of an effective voltage value due to a blunt waveform or due to induced distortion. Therefore, a correction amount is not determined every horizontal scanning period, but is determined every correction period.

Further, an induced distortion correction amount S221 is determined in a manner similar to that of Example 1 (S2004 shown in FIG. 10B). As described above, in the correction amount LUT 224, the induced distortion correction amount S221 for correcting the increment or decrement of an effective voltage value due to induced distortion, the blunt waveform correction amount S222 for correcting the increment or decrement of an effective voltage value due to a blunt waveform, and the gradation correction amount S223 for correcting the increment or decrement of an effective voltage value due to the gradation phenomenon are determined for each column electrode 72 (FIG. 10A) and output to the adder 225.

In the adder 225, the received induced distortion correction amount S221, blunt waveform correction amount S222, and gradation correction amount S223 are added or subtracted together. Similar to Example 1, an error ERR is added to or subtracted from an induced distortion correction amount corresponding to the next correction period (S1006 shown in FIG. 10B), and a correction voltage is applied to each column electrode 72 (FIG. 10A) based on correction data (S1007 shown in FIG. 10B).

The operation line memory 26 and other elements thereafter have the same circuit structure and operation as those of Example 1.

A look-up table for correction amounts corresponding to blunt waveforms is not limited to the blunt waveform LUT 229 of FIG. 12. A look-up table for correction amounts corresponding to gradation phenomena is not limited to the gradation LUT 230 of FIG. 13. These look-up tables may be optimally designed in accordance with properties of a liquid crystal panel used.

As described above, in the present invention, a means for optimally correcting induced distortion crosstalk due to a change in signal voltage is provided, thereby suppressing induced distortion crosstalk and improving the display quality of an LCD device.

Further, a correction period which is equal to m horizontal scanning periods are provided in L horizontal scanning periods, where L is an integer greater than or equal to 2 and m is an integer more than 0 and less than L. Therefore, correction amounts corresponding to (L−m) horizontal scanning periods can be accumulated, thereby reducing a correction error.

Furthermore, it is possible to detect a bluntness amount of a signal voltage waveform due to a change in signal voltage. Blunt waveform crosstalk can be suppressed by performing correction in accordance with the bluntness amount in the correction period. A means for generating a correction voltage which is varied every one or more column electrodes is provided. Therefore, the gradation phenomenon can be suppressed by providing the correction voltage in the correction period.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for driving a liquid crystal display device including a plurality of row electrodes and a plurality of column electrodes, a scanning voltage being applied to each of the plurality of row electrodes, a signal voltage being applied to each of the plurality of column electrodes, and the plurality of row electrodes intersecting the plurality of column electrodes, the method comprising the steps of:

a) determining, for each of the plurality of column electrodes, correction data for correcting the signal voltage based on an increment or decrement of an effective voltage value between each of the plurality of row electrodes and the plurality of column electrodes; and b) applying a correction voltage for correcting the signal voltage to each of the column electrodes in accordance with correction data determined in association therewith, wherein an increment or decrement of the effective voltage value includes at least either of i) an increment or decrement of an effective voltage value due to at least either a blunt waveform or induced distortion of the signal voltage, or ii) an increment or decrement of an effective voltage value due to at least either a blunt waveform or induced distortion of the scanning voltage;

wherein the correction voltage associated with each of the plurality of column electrodes is applied to its associated electrode in a correction period, and the correction period equal to m horizontal scanning period is provided in L horizontal scanning periods where L is an integer greater than or equal to 2 and m is an integer more than 0 and less than L.

2. A method according to claim 1, wherein the correction data is determined based on a position of each of the plurality of column electrodes.

3. A method according to claim 1, wherein step a) further comprises the step of:

c) detecting a change in the signal voltage applied to each of the column electrodes as a digital amount and outputting the digital amount to each of the column electrodes.

4. A method according to claim 3, wherein an increment or decrement of the effective voltage value is an increment or decrement of an effective voltage value due to induced distortion of the scanning voltage, and step c) further comprises the step of detecting, for each of the plurality of column electrodes, a change in the signal voltage based on a row driver control signal, and $n^{th}$ row display data and $(n-1)^{th}$ row display data.

5. A method according to claim 3, wherein step c) further comprises the step of detecting a change in the signal voltage for each of the plurality of column electrodes, and calculating an induced distortion count value representing the total change in the signal voltage over all of the plurality of column electrodes.

6. A method according to claim 5, wherein step a) further comprises the step of:

d) calculating, for each of the plurality of column electrodes, an induced distortion correction amount based on the induced distortion count value and a lateral position count value representing a position of each of the plurality of column electrodes in a lateral direction along the plurality of row electrodes.

7. A method according to claim 6, wherein step d) further comprises the steps of:

calculating an induced distortion correction variable based on the lateral position count value and a frame number; and calculating the induced distortion correction amount based on the distortion correction variable and the induced distortion count value.

8. A method according to claim 6, wherein the correction voltage is applied to each of the plurality of column electrodes in a correction period, and the correction period equal to m horizontal scanning periods is provided in L horizontal scanning periods where L is an integer greater than or equal to 2 and m is an integer more than 0 and less than L, and step a) further comprises the step of adding or subtracting an error between the correction data and the induced distortion correction amount, the correction data being applied to each of the plurality of column electrodes, to or from an induced distortion correction amount corresponding to a next correction period.

9. A method according to claim 3, wherein an increment or decrement of the effective voltage value is an increment or decrement of an effective voltage value due to a blunt waveform of the scanning voltage, and step c) further comprises the step of detecting, for each of the plurality of column electrodes, a signal voltage change signal based on $n^{th}$ row display data and $(n-1)^{th}$ row display data.

10. A method according to claim 9, wherein the signal voltage change signal includes an $n^{th}$ row signal voltage and an $(n-1)^{th}$ row signal voltage for each of the plurality of column electrodes.

11. A method according to claim 9, wherein step c) further comprises the step of calculating a blunt waveform correction amount for correcting a blunt waveform of the scanning voltage base on the signal voltage change signal.

12. A method according to claim 1, wherein step a) further comprises the step of calculating a gradation correction amount for correcting a gradation phenomenon based on a lateral position count value representing a position of each of the plurality of column electrodes in a lateral direction along the plurality of row electrodes.

13. A method according to claim 1, wherein each correction voltage has a different pulse width.

14. A method according to claim 1, wherein each correction voltage has a different pulse amplitude.

15. A liquid crystal display device including a plurality of row electrodes and a plurality of column electrodes, a scanning voltage being applied to each of the plurality of row electrodes, a signal voltage being applied to each of the plurality of column electrodes, and the plurality of row electrodes intersecting the plurality of column electrodes, the device comprising:

a correction operation circuit for determining for each of the plurality of column electrodes, correction data for correcting the signal voltage based on an increment or decrement of an effective voltage value between each of the plurality of row electrodes and the plurality of column electrodes; and a column driver unit for applying a correction voltage for correcting the signal voltage to each of the plurality of column electrodes in accordance with the correction data determined in association therewith, and a timing control circuit for providing a correction period, wherein the correction voltage associated with each of the plurality of column electrodes is applied to its associated electrode in the correction period, and the correction period equal to m horizontal scanning periods is provided in L horizontal scanning periods where L is an integer greater than or equal to 2 and m is an integer more than 0 and less than L;

wherein an increment or decrement of the effective voltage value includes at least either of i) an increment or decrement of an effective voltage value due to at least either a blunt waveform or induced distortion of the signal voltage or ii) an increment or decrement of an effective voltage due to at least either a blunt waveform or induced distortion of the scanning voltage.

16. A device according to claim 15, wherein the correction operation circuit determines the correction data based on a position of each of the plurality of column electrodes.

17. A device according to claim 15, wherein the correction operation circuit comprises a column waveform change detection unit for detecting a change in the signal voltage applied to each of the plurality of column electrodes as a digital amount and outputting the digital amount to each of the plurality of column electrodes.

18. A device according to claim 17, wherein an increment or decrement of the effective voltage value is an increment or decrement of an effective voltage value due to induced distortion of the scanning voltage, and the column waveform change detection unit detects, for each of the plurality of column electrodes, a change in the signal voltage based on a row driver control signal, and $n^{th}$ row display data and $(n-1)^{th}$ row display data.

19. A device according to claim 17, wherein the correction operation circuit comprises a counter for detecting a change in the signal voltage for each of the plurality of column electrodes, and calculating an induced distortion count value representing the total change in the signal voltage over all of the plurality of column electrodes.

20. A device according to claim 19, wherein the correction operation circuit comprises a correction amount look-up table for calculating, for each of the plurality of column electrodes, an induced distortion correction amount based on the induced distortion count value and a lateral position count value representing the position of each of the plurality of column electrodes in a lateral direction along the plurality of row electrodes.

21. A device according to claim 20, wherein the correction amount look-up table comprises:

a look-up table for calculating an induced distortion correction variable based on the lateral position count value and a frame number; and an induced distortion look-up table for calculating the induced correction amount based on the the induced distortion correction variable and the induced distortion count value.

22. A device according to claim 20, wherein the correction voltage is applied to each of the plurality of column electrodes in a correction period, and the correction period equal to m horizontal scanning periods is provided in L horizontal scanning periods where L is an integer greater than or equal to 2 and m is an integer more than 0 and less than L, and the correction operation circuit further comprises an adder for adding or subtracting an error between the correction data and the induced distortion correction amount, the correction data being applied to each of the plurality of column electrodes, to or from an induced distortion correction amount corresponding to a next correction period.

23. A device according to claim 17, wherein an increment or decrement of the effective voltage value is an increment or decrement of an effective voltage value due to a blunt waveform of the scanning voltage, and the column waveform change detection unit detects, for each of the plurality of column electrodes, a signal voltage change signal based on the $n^{th}$ row display data and the $(n-1)^{th}$ row display data.

24. A device according to claim 23, wherein the signal voltage change signal includes an $n^{th}$ row signal voltage and an $(n-1)^{th}$ row signal voltage for each of the plurality of column electrodes.

25. A device according to claim 23, wherein the correction operation circuit comprises a blunt waveform look-up table for calculating a blunt waveform correction amount for correcting a blunt waveform of the scanning voltage based on the signal voltage change signal.

26. A device according to claim 15, wherein the correction operation circuit comprises a gradation look-up table for calculating a gradation correction amount for the correction of a gradation phenomenon based on a lateral position count value representing the position of each of the plurality of column electrodes in a lateral direction along the plurality of row electrodes.

27. A device according to claim 15, wherein each correction voltage has a different pulse width.

28. A device according to claim 15, wherein each correction voltage has a different pulse amplitude.

* * * * *